US011383907B2

(12) United States Patent
Gonzalez Manzano et al.

(10) Patent No.: US 11,383,907 B2
(45) **Date of Patent: *Jul. 12, 2022**

(54) CARRIER FOR CONTAINERS

(71) Applicant: Graphic Packaging International, LLC, Atlanta, GA (US)

(72) Inventors: Ana Maria Gonzalez Manzano, Igualada (ES); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/119,040

(22) Filed: Dec. 11, 2020

(65) Prior Publication Data

US 2021/0094742 A1 Apr. 1, 2021

Related U.S. Application Data

(63) Continuation of application No. 29/739,931, filed on Jun. 30, 2020, now Pat. No. Des. 946,419, and a (Continued)

(51) Int. Cl.
*B65D 71/42* (2006.01)

(52) U.S. Cl.
CPC ..... *B65D 71/42* (2013.01); *B65D 2571/0066* (2013.01); *B65D 2571/00314* (2013.01); *B65D 2571/00932* (2013.01)

(58) Field of Classification Search
CPC ..... B65D 71/42; B65D 71/00314; B65D 2571/0066; B65D 2571/00932;
(Continued)

(56) References Cited

U.S. PATENT DOCUMENTS 1,527,399 A 2/1925 Davidson
2,289,859 A 7/1942 Arthur
(Continued)

FOREIGN PATENT DOCUMENTS

AT 399701 B 7/1995
CA 2133827 10/1993
(Continued)

OTHER PUBLICATIONS

International Search Report and Written Opinion for PCT/US2019/034491 dated Sep. 19, 2019.
(Continued)

*Primary Examiner* — Chun Hoi Cheung
(74) *Attorney, Agent, or Firm* — Womble Bond Dickinson (US) LLP

(57) ABSTRACT

A carrier for holding a plurality of containers includes a plurality of panels including at least one central panel and at least one attachment panel foldably connected to the at least one central panel, the at least one attachment panel including container retention features for engaging at least one container of the plurality of containers. The at least one central panel includes a plurality of openings and is for being positioned between and attached to adjacent containers of the plurality of containers.

56 Claims, 29 Drawing Sheets

Related U.S. Application Data continuation of application No. 29/739,934, filed on Jun. 30, 2020, now Pat. No. Des. 946,421, and a continuation of application No. 29/739,933, filed on Jun. 30, 2020, now Pat. No. Des. 946,420, and a continuation-in-part of application No. 16/426,066, filed on May 30, 2019, now Pat. No. 11,180,301.

(60) Provisional application No. 63/023,442, filed on May 12, 2020, provisional application No. 63/022,757, filed on May 11, 2020, provisional application No. 63/015,898, filed on Apr. 27, 2020, provisional application No. 62/841,449, filed on May 1, 2019, provisional application No. 62/817,120, filed on Mar. 12, 2019, provisional application No. 62/814,412, filed on Mar. 6, 2019, provisional application No. 62/810,015, filed on Feb. 25, 2019, provisional application No. 62/797,585, filed on Jan. 28, 2019, provisional application No. 62/796,830, filed on Jan. 25, 2019, provisional application No. 62/783,752, filed on Dec. 21, 2018, provisional application No. 62/779,689, filed on Dec. 14, 2018.

(58) Field of Classification Search
CPC ..... B65D 2571/00925; B65D 2571/00716; B65D 71/48; B65D 71/003
USPC ..... 206/151–155
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,223,308 A 12/1965 Weiss
3,245,711 A 4/1966 Dantoin
3,257,066 A 6/1966 Williams
3,281,180 A * 10/1966 Spery ..... B65D 71/48 294/87.2
3,302,784 A 2/1967 Copping
3,387,879 A * 6/1968 Wood ..... B65D 71/46 294/87.2
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Pitch
D222,579 S 11/1971 Oglesbee
3,627,121 A 12/1971 Deasy
3,653,503 A 4/1972 Arneson
3,693,787 A 9/1972 Duerr
3,701,416 A 10/1972 Lawrence
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
D257,001 S 9/1980 Oliff
4,244,617 A 1/1981 Manizza
4,304,329 A 12/1981 Graser
4,339,032 A 7/1982 Wood
4,372,599 A 2/1983 Kiedaisch et al.
4,378,879 A 4/1983 Killy
4,382,505 A 5/1983 Sutherland et al.
4,441,611 A 4/1984 Sommariva
4,471,870 A 9/1984 Uhlig
4,523,676 A 6/1985 Barrash
4,784,266 A 11/1988 Chaussadas
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
5,188,225 A 2/1993 Jorba
5,193,673 A 3/1993 Rathbone et al.
5,201,412 A * 4/1993 Schuster ..... B65D 71/44 206/153
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,484,053 A 1/1996 Harris
5,485,914 A 1/1996 Martin
5,487,464 A 1/1996 Galbierz et al.
5,490,593 A 2/1996 Gordon et al.
5,503,267 A 4/1996 Sutherland
5,520,283 A 5/1996 Sutherland
5,524,756 A 6/1996 Sutherland
5,551,566 A 9/1996 Sutherland
5,553,704 A 9/1996 Gordon et al.
5,553,705 A 9/1996 Bakx
5,573,111 A 11/1996 Gordon
5,590,776 A 1/1997 Galbierz
5,593,027 A 1/1997 Sutherland
5,609,247 A 3/1997 Appleton
5,609,251 A 3/1997 Harris
5,609,379 A 3/1997 Harrelson
5,682,982 A 11/1997 Stonehouse
5,706,936 A 1/1998 Bernstein
5,711,419 A 1/1998 Beales et al.
5,735,394 A 4/1998 Harrelson

(56) References Cited

U.S. PATENT DOCUMENTS

| | | | |
|---|---|---|---|
| 5,746,310 | A | 5/1998 | Slomski |
| 5,762,193 | A | 6/1998 | Marco |
| 5,791,463 | A | 8/1998 | Negelen |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,096,413 | B2 | 1/2012 | DePaula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr |
| 10,077,131 | B2 | 9/2018 | Lettre |
| 10,836,550 | B2 | 11/2020 | Zacherle |
| D920,809 | S | 6/2021 | Chesnet et al. |
| 11,027,905 | B2 | 6/2021 | Ford |
| 11,180,301 | B2 | 11/2021 | Smalley |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2012/0138489 | A1 | 6/2012 | Holley, Jr. |
| 2014/0183069 | A1* | 7/2014 | Spivey, Sr. ..... B65D 71/46 206/153 |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |

FOREIGN PATENT DOCUMENTS

| | | | |
|---|---|---|---|
| DE | 298 13 672 | U1 | 11/1998 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| FR | 2 737 196 | A1 | 1/1997 |
| GB | 1 256 684 | | 12/1971 |
| GB | 2 321 229 | A | 7/1998 |
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| KR | 10-2005-0051616 | A | 6/2005 |
| KR | 10-2020-0106806 | A | 9/2020 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2008/058294 | A1 | 5/2008 |
| WO | WO 2010/006629 | A1 | 1/2010 |
| WO | WO 2010/101852 | A1 | 9/2010 |

OTHER PUBLICATIONS

International Search Report and Written Opinion for PCT/US2019/034490 dated Sep. 19, 2019.
International Search Report and Written Opinion for PCT/US2019/034494 dated Sep. 19, 2019.
International Search Report and Written Opinion for PCT/US2019/034489 dated Sep. 19, 2019.
International Search Report and Written Opinion for PCT/US2019/034493 dated Sep. 20, 2019.
International Search Report and Written Opinion for PCT/US2020/024614 dated Sep. 15, 2020.
European Search Report for EP 19 18 0439 dated Jan. 10, 2020.
European Search Report for EP 19 18 0460 dated Jan. 13, 2020.
European Search Report for EP 19 18 0436 dated Jan. 22, 2020.
European Search Report for EP 19 18 0446 dated Feb. 3, 2020.
European Search Report for EP 19 18 0453 dated Feb. 10, 2020.
European Search Report for EP 20 16 8268 dated Oct. 2, 2020.
International Search Report and Written Opinion for PCT/US2020/064472 dated Mar. 15, 2021.
International Search Report and Written Opinion for PCT/US2020/064471 dated Mar. 29, 2021.
International Search Report and Written Opinion for PCT/US2020/064473 dated Apr. 1, 2021.
European Search Report for EP 20 20 533 dated Mar. 23, 2021.
European Search Report for EP 20 21 5364 dated Jul. 1, 2021.
European Search Report for EP 20 21 5371 dated Jul. 1, 2021.
European Search Report for EP 20 21 5399 dated Jul. 1, 2021.

(56) References Cited

OTHER PUBLICATIONS

International Search Report and Written Opinion for PCT/US2020/054205 dated Jan. 20, 2021.
International Search Report and Written Opinion for PCT/US2021/052279 dated Jan. 5, 2022.
International Search Report and Written Opinion for PCT/US2021/052278 dated Jan. 5, 2022.
International Search Report and Written Opinion for PCT/US2021/052272 dated Jan. 7, 2022.
International Search Report and Written Opinion for PCT/US2021/052290 dated Jan. 21, 2022.

* cited by examiner

CARRIER FOR CONTAINERS

CROSS-REFERENCE TO RELATED APPLICATIONS

This application is a continuation-in-part of U.S. patent application Ser. No. 16/426,066, filed on May 30, 2019, which application claims the benefit of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, and U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, and U.S. Provisional Patent Application No. 62/841,449, filed on May 1, 2019. This application claims the benefit of U.S. Provisional Patent Application No. 63/023,442, filed on May 12, 2020, U.S. Provisional Patent Application No. 63/015,898, filed on Apr. 27, 2020, and U.S. Provisional Patent Application No. 63/022,757, filed on May 11, 2020, and is a continuation of U.S. Design patent application Ser. No. 29/739,931, filed on Jun. 30, 2020, U.S. Design patent application Ser. No. 29/739,933, filed on Jun. 30, 2020, and U.S. Design patent application Ser. No. 29/739,934, filed on Jun. 30, 2020.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/841,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application Ser. No. 29/692,992, filed on May 30, 2019, U.S. Design patent application Ser. No. 29/692,993, filed on May 30, 2019, U.S. Design patent application Ser. No. 29/692,994, filed on May 30, 2019, U.S. Design patent application Ser. No. 29/692,996, filed on May 30, 2019, U.S. Design patent application Ser. No. 29/692,997, filed on May 30, 2019, U.S. patent application Ser. No. 16/598,282, filed on Oct. 10, 2019, U.S. Design patent application Ser. No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional Patent Application No. 63/022,757, filed on May 11, 2020, U.S. Provisional Patent Application No. 63/023,442, filed on May 12, 2020, U.S. Design patent application Ser. No. 29/735,178, filed on May 19, 2020, U.S. Provisional Patent Application No. 63/031,615, filed on May 29, 2020, U.S. Design patent application Ser. No. 29/739,927, filed on Jun. 30, 2020, U.S. Design patent application Ser. No. 29/739,929, filed on Jun. 30, 2020, U.S. Design patent application Ser. No. 29/739,931, filed on Jun. 30, 2020, U.S. Design patent application Ser. No. 29/739,933, filed on Jun. 30, 2020, U.S. Design patent application Ser. No. 29/739,934, filed on Jun. 30, 2020, U.S. Provisional Patent Application No. 63/085,365, filed on Sep. 30, 2020, and U.S. Provisional Patent Application No. 63/086,681, filed on Oct. 2, 2020, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a plurality of panels comprising at least one central panel and at least one attachment panel foldably connected to the at least one central panel, the at least one attachment panel comprising container retention features for engaging at least one container of the plurality of containers. The at least one central panel comprises a plurality of openings and is for being positioned between and attached to adjacent containers of the plurality of containers.

According to another aspect, the disclosure is generally directed to a blank for forming a carrier for holding a plurality of containers, the blank comprising a plurality of panels comprising at least one central panel and at least one attachment panel foldably connected to the at least one central panel, the at least one attachment panel comprising container retention features for engaging at least one container of the plurality of containers when the carrier is formed from the blank. The at least one central panel comprises a plurality of openings and is for being positioned between and attached to adjacent containers of the plurality of containers when the carrier is formed from the blank.

According to another aspect, the disclosure is generally directed to a method of forming a carrier for holding a plurality of containers, the method comprising obtaining a blank comprising a plurality of panels comprising at least one central panel and at least one attachment panel foldably connected to the at least one central panel, the at least one attachment panel comprising container retention features and the at least one central panel comprises a plurality of openings. The method further comprises folding the plurality of panels such that the at least one central panel is positioned between adjacent containers of the plurality of containers, attaching the at least one central panel to at least one container of the plurality of containers, and attaching the attachment panel to at least one container of the plurality of containers by engaging the at least one container of the plurality of containers with the container retention features.

According to another aspect, the disclosure is generally directed to a package, the package comprising a plurality of containers and a carrier holding a plurality of containers. The carrier comprises a plurality of panels comprising at least one central panel and at least one attachment panel foldably connected to the at least one central panel, the at least one attachment panel comprising container retention features engaging at least one container of the plurality of containers. The at least one central panel comprises a plurality of openings and is positioned between and attached to adjacent containers of the plurality of containers.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
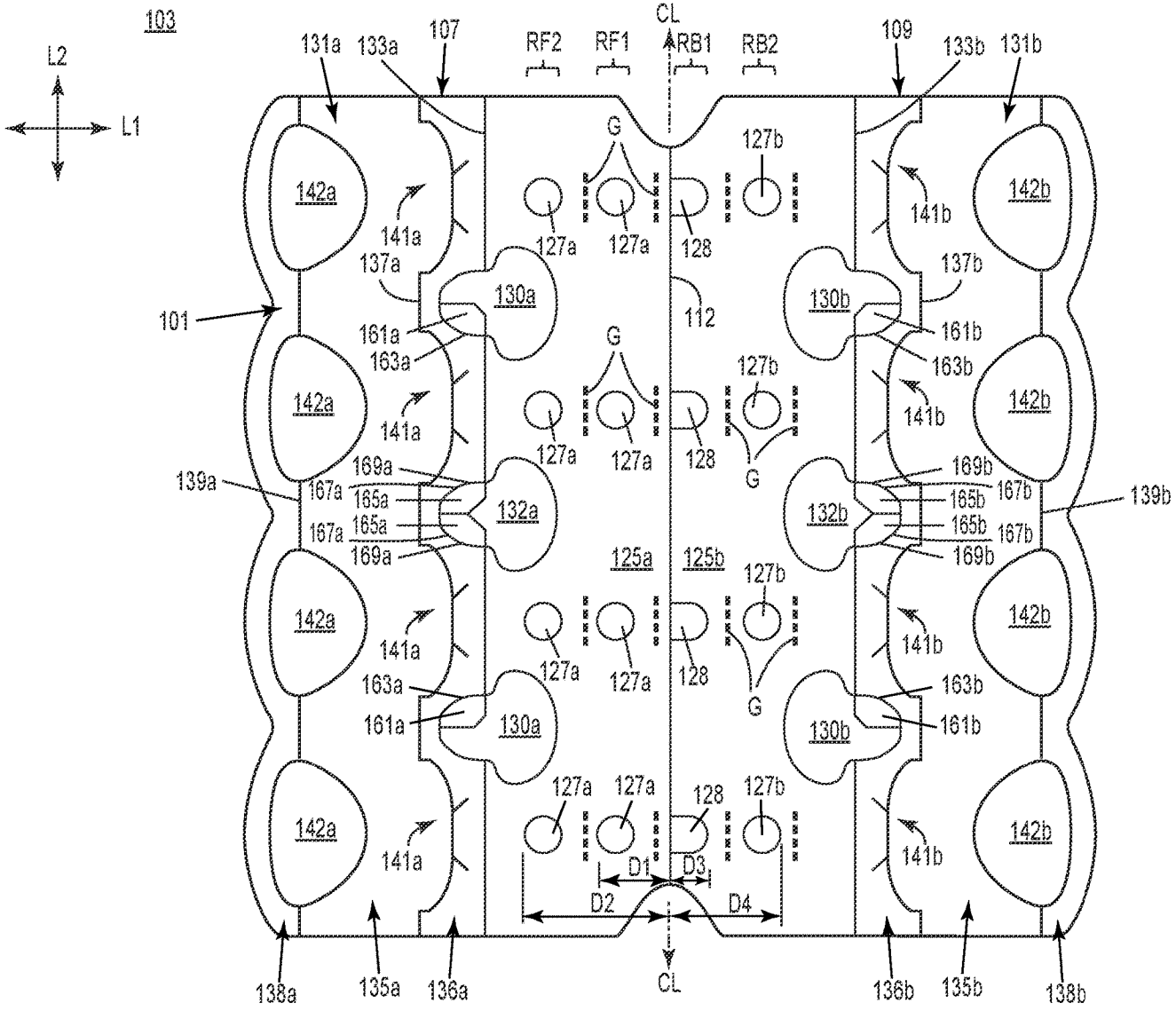
FIG. 1 is a schematic plan view of an outer surface of a blank for forming a carrier according to a first exemplary embodiment of the disclosure.
Figure 6:
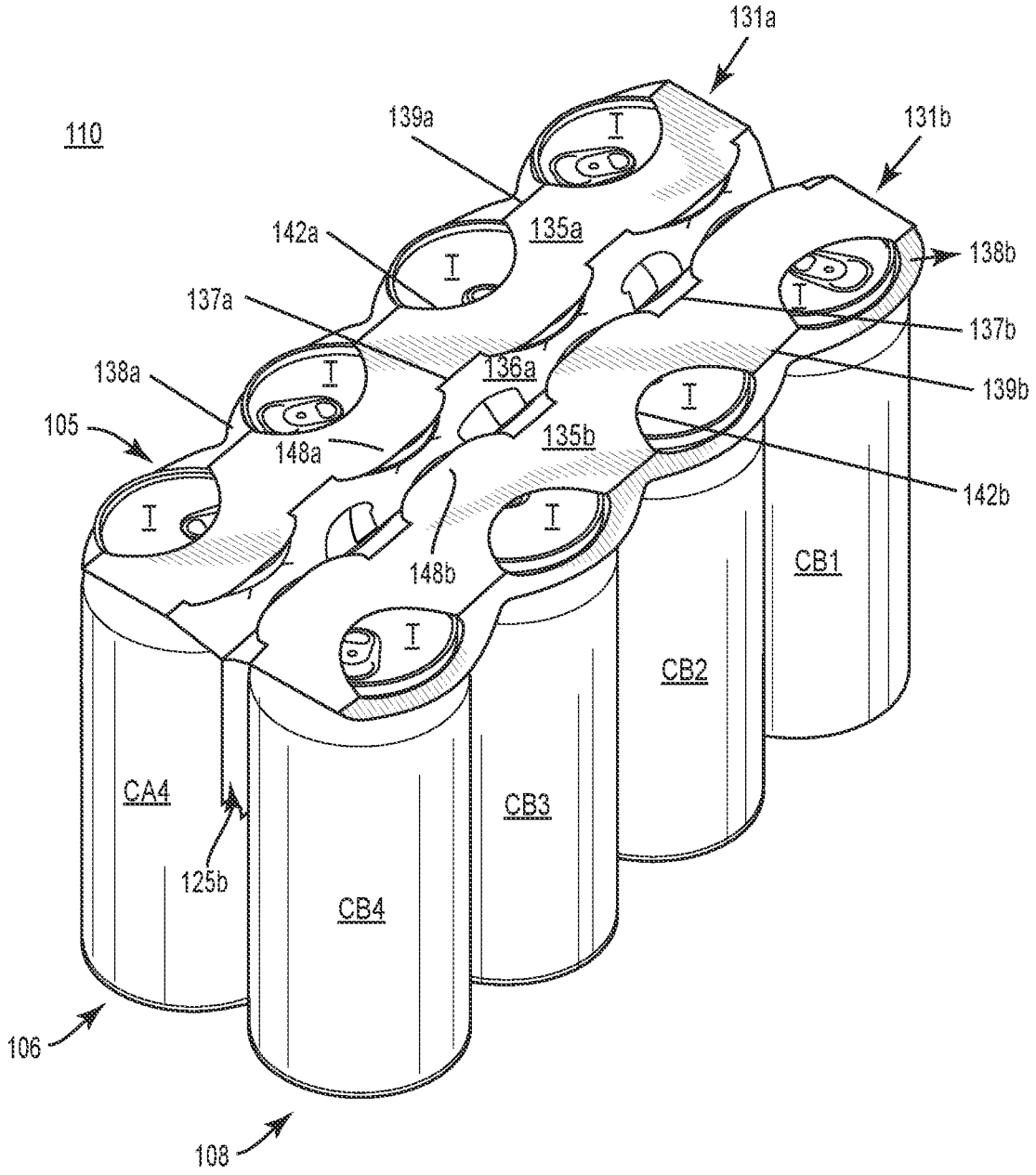
FIG. 6 is a perspective view of a package and carrier formed from the blank of FIG. 1 according to the first exemplary embodiment.

FIG. 1 shows a schematic plan view of an exterior side 101 of a blank 103 used to form a carrier 105 (FIG. 6) in accordance with a first exemplary embodiment of the disclosure. As shown in FIG. 6, the carrier 105 is sized to contain or support eight containers, with four containers CA1, CA2, CA3, CA4 being attached to a front portion 106 of the carrier 105 and four containers CB1, CB2, CB3, CB4 being attached to a back portion 108 of the carrier 105. In the illustrated embodiment, the containers CA1, CA2, CA3, CA4, CB1, CB2, CB3, CB4 can be beverage cans, or could be any other suitable type and size of container without departing from the disclosure. The carrier 105 can be sized and shaped to hold more or less than eight containers.

In one embodiment, the front portion 106 and the back portion 108 of the carrier 105 each have four containers, and in other embodiments, the front portion 106 and the back portion 108 of the carrier 105 can carry more or less than four containers without departing from the disclosure. The carrier 105 can be provided together with one or more containers as a package 110 (FIG. 6).

As shown in FIG. 1, the blank 103 has a longitudinal axis L1 and a lateral axis L2. The blank 103 has a front portion 107 for forming the front portion 106 of the carrier 105, and a back portion 109 for forming the back portion 108 of the carrier 105. The front portion 107 and the back portion 109 of the blank 103 are foldably connected at a lateral fold line 112 that forms a lateral centerline CL of the blank 103, as shown. As discussed further below, the blank 103 is at least partially formed into the carrier 105 by folding the blank 103 at the fold line 112 along the centerline CL so that the front portion 107 and the back portion 109 of the blank 103 are overlapped in at least partial face-to-face contact.

In the illustrated embodiment, the front portion 107 of the blank 103 comprises a front central panel 125*a* having a first front row RF1 of laterally spaced adhesive or glue openings 127*a*, and a second front row RF2 of the laterally spaced adhesive or glue openings 127*a*. The top edges of the respective glue openings 127*a* of the first row RF1 are spaced a longitudinal distance D1 apart from the fold line 112 that is less than a longitudinal distance D2 that the top edges of the respective glue openings 127*a* of the second row RF2 are spaced apart from the fold line 112.

A front container retention panel or front attachment panel 131*a* is foldably connected to the front central panel 125*a* at a lateral fold line 133*a*, and includes a container retention portion 135*a* that is at least partially defined between a pair of longitudinally-spaced lateral fold lines 137*a*, 139*a* (broadly, "first fold line" and "second fold line", respectively. Each fold line 137*a*, 139*a* is interrupted by laterally-spaced cuts 141*a* and laterally-spaced container openings 142*a*, respectively. In this regard, the front attachment panel 131*a* has four sets or groups of container retention features that each cooperate to engage a respective one of the four containers CA1, CA2, CA3, C4. In one embodiment each set of container retention features include at least the cuts 141*a* and the openings 142*a* that engage a respective container CA1, CA2, CA3, C4, but in later embodiments, the container retention features could comprise other features in the attachment panels that attach the package 110/carrier 105 to the containers.

Figure 1B:
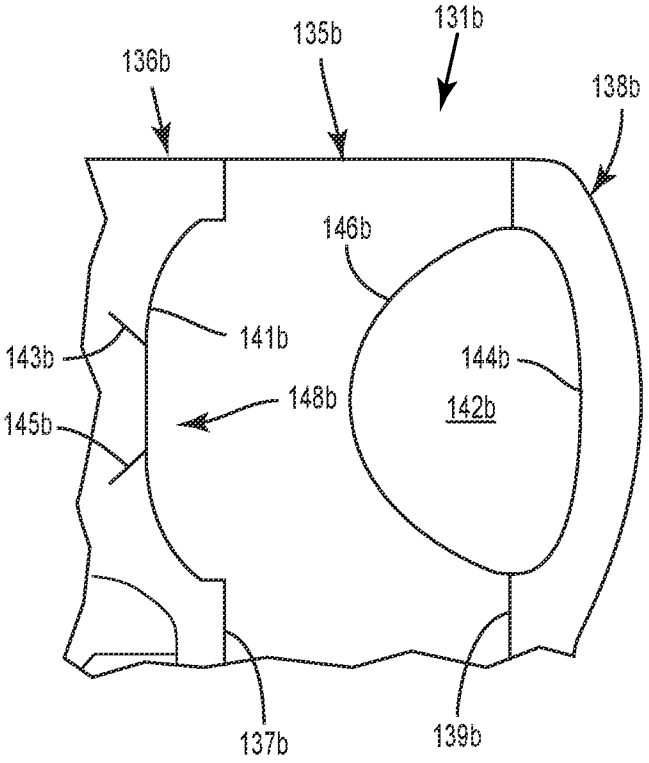
FIG. 1B is an enlarged view of another portion of the blank of FIG. 1.
Figure 1A:
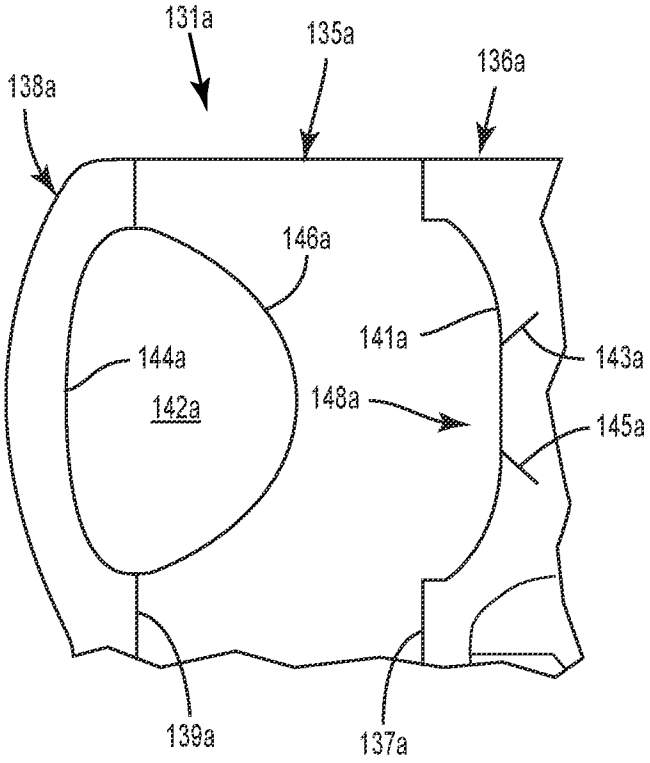
FIG. 1A is an enlarged view of a portion of the blank of FIG. 1.

As best shown in FIG. 1A, the laterally-spaced cuts 141*a* can each include one or more curved and/or angled portions and define container retention tabs 148*a* that extend outwardly from the container retention portion 135*a*. As also shown, respective oblique cuts 143*a*, 145*a* extend outwardly from each respective cut 141*a* to define a plurality of reconfigurable edges of the front attachment panel 131*a* that face the respective container retention tabs 148*a*.

As also shown, the container openings 142*a* can each be defined by cuts that include a generally curved longitudinally outer edge 144*a* with endpoints connected by generally U-shaped or generally V-shaped longitudinally inner edge 146*a*. In one embodiment, the container openings 142*a* can have a generally tapered profile that narrows from the outer edge 144*a* to the inner edge 146*a* toward the centerline CL.

As shown, an interior marginal portion 136*a* of the attachment panel 131*a* is defined between the fold lines 137*a*, 133*a*, and an exterior marginal portion 138*a* of the attachment panel 131*a* is defined between the fold line 139*a* and a lateral free edge of the attachment panel 131*a*. In the illustrated embodiment, the exterior marginal portion 138*a* of the attachment panel 131*a* can have a generally curved outer lateral edge that generally follows/contours the curvature of the outer edge 144*a* of the container openings 142*a*. In this regard, and as described further below, the outer marginal portion 138*a* of the attachment panel 131*a* can have the form of a generally continuous clip or band for facilitating engagement of the containers CA1, CA2, CA3, CA4 to the carrier 105.

The blank 103 can include handle features that include at least a pair of handle openings 130*a* that interrupts the fold line 133*a* and that extends from a portion of the front central panel 125*a* into a portion of the front attachment panel 131*a*. The handle openings 130*a* can be formed by one or more cuts that include one or more curved and/or angled portions. A handle reinforcement tab 161*a*, as shown, can be foldably connected to the front attachment panel 131*a* at respective longitudinal fold lines 163*a* and can be positioned to extend into the respective handle openings 130*a*.

As also shown, the handle features can include a handle opening 132*a* that can be positioned between the handle openings 130*a*, and is formed in the front central panel 125*a* by one or more cuts that include one or more curved and/or angled portions. A pair of handle reinforcement tabs 165*a* can also be at least partially formed by respective curved cuts 167*a* and separated from one another at a longitudinal cut. The handle reinforcement tabs 165*a*, as shown, can be foldably connected to the front attachment panel 131*a* at respective longitudinal fold lines 169*a* and can be positioned extending into the handle opening 132*a*.

In the illustrated embodiment, each of the handle features including a respective handle opening 130*a*, 132*a*, and respective handle reinforcement tabs 161*a*, 165*a*. Each of the respective handle features is positioned between respective adjacent sets of the container retentions features (i.e., cuts 141*a*, openings 142*a*, etc.) so that the handle features are located between respective containers CA1, CA2, CA3, CA4 to allow the carrier to be grasped at the handle openings 130*a*, 132*a* without interfering with the containers. The carrier 105 can have a different arrangement of handle features, or can be devoid of handle features, without departing from the disclosure.

In the illustrated embodiment, the back portion 109 of the blank 103 includes a back central panel 125*b* and a back container retention panel or back attachment panel 131*b* having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103. The container retention features of the back attachment panel 131*b* are best shown in FIG. 1B.

As shown, the back central panel 125*a* includes a first back lateral row of glue openings 128 that at least partially interrupt the fold line 112 and have an upper edge spaced a longitudinal distance D3 from the fold line 112. The back central panel 125*b* also includes a second back lateral row RB2 of glue openings 127*b* with an upper edge spaced apart a longitudinal distance D4 from the fold line 112, the longitudinal distance D4 being greater than the longitudinal distance D3.

In the illustrated embodiment, the glue openings 127*a*, 127*b* can have a generally circular profile and the glue openings 128 can have a generally semicircular/semi-ovoid configuration. It will be understood that one or more of the glue openings 127*a*, 127*b*, 128 can have a different configuration than provided in FIG. 1, e.g., generally circular, generally oblong, generally semicircular/semi-ovoid, generally rectangular, etc., without departing from the disclosure.

In this regard, the blank 103 is provided with front rows RF1 and RF2 of respective laterally-spaced front glue openings 127*a* that are spaced respective longitudinal distances D1, D2 from the centerline CL, and back rows RB1 and RB2 of respective laterally-spaced back glue openings 128, 127*b* that are spaced respective longitudinal distances D3, D4 from the centerline CL. The glue openings 127*a*, 127*b*, 128 have a longitudinally staggered arrangement such that D2>D4>D1>D3. Upon formation of the carrier 105 from the blank 103, the longitudinal centerline CL/fold line 112 can form a bottom edge of the central panels 125*a*, 125*b*.

As described herein, the arrangement of the glue openings 127*a*, 127*b*, 128 is such that, upon erection of the carrier 105, the glue openings 127*a* provide access to respective surfaces of the central panel 125*b* upon which the respective containers CA1, CA2, CA3, CA4 can be attached and the glue openings 128, 127*b* provide access to respective surfaces of the central panel 125*a* upon which the respective containers CB1, CB2, CB3, CB4 can be attached. Such an arrangement of the glue openings 127*a*, 127*b*, 128 to enhance retention and support of the containers CA1, CA2, CA3, CA4, CB1, CB2, CB3, CB4 by the carrier 105. It will be understood that the glue openings 127*a*, 127*b*, 128 can be provided in a different number or arrangement without departing from the disclosure.

Any of the panels, flaps, fold lines, cuts, or other features could be otherwise shaped, arranged, and/or omitted from the blank 103 without departing from the disclosure. The blank 103 could be sized and/or shaped to accommodate more or less than eight containers without departing from this disclosure.

Figure 2:
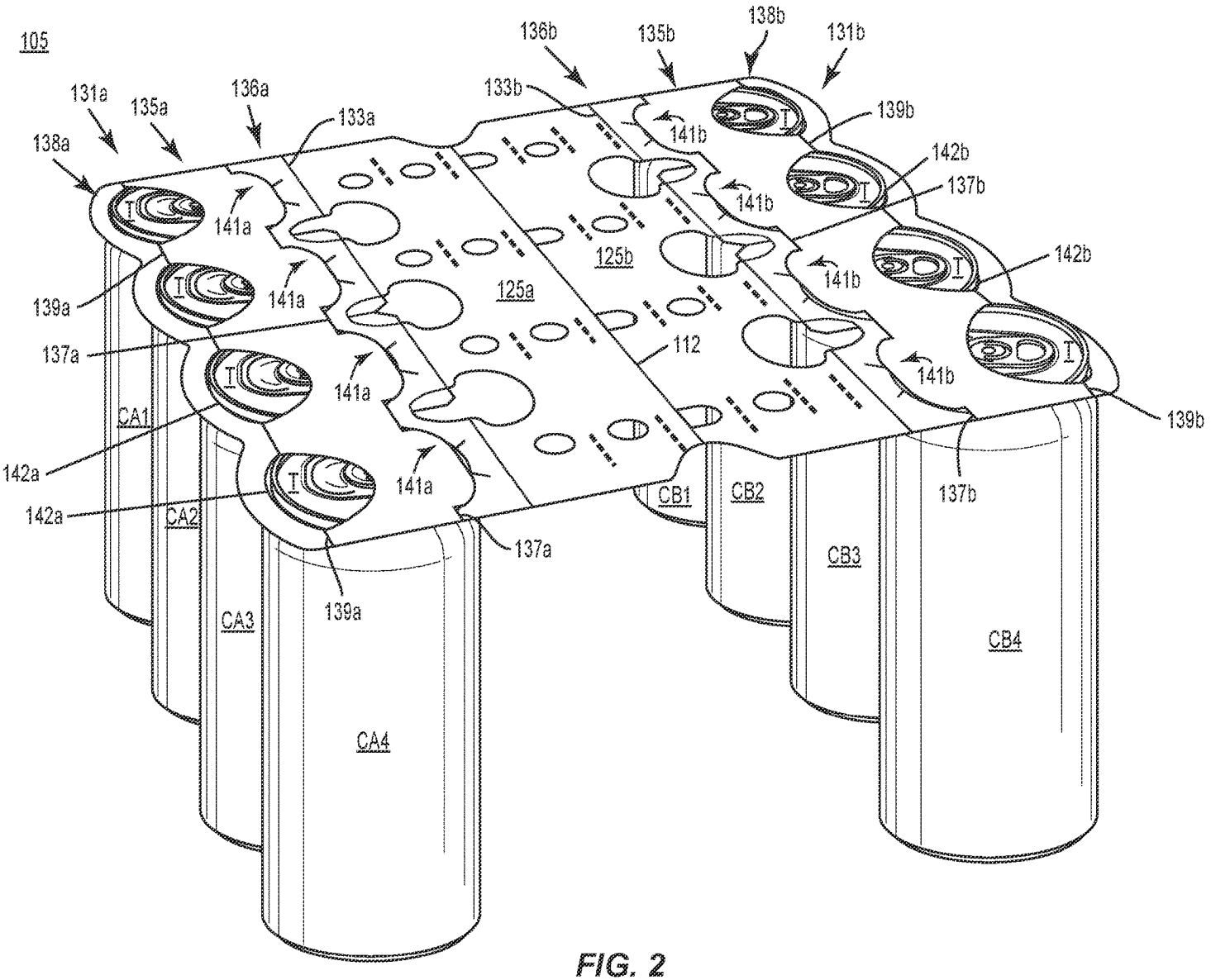
FIG. 2 is perspective view of a partially folded configuration of a carrier formed from the blank of FIG. 1 according to the first exemplary embodiment.

As shown in FIG. 2, the blank 103 can be positioned with the exterior surface 101 facing upwardly and such that an underside or interior surface of the blank 103 is positioned facing the containers CA1, CA2, CA3, CA4, CB1, CB2, CB3, CB4. The blank 103 can be placed atop the containers CA1, CA2, CA3, CA4, CB1, CB2, CB3, CB4 such that the container retention portion 135*a* of the front attachment panel 131*a* overlies the containers CA1, CA2, CA3, CA4 and such that the container retention portion 135*b* of the back attachment panel 131*b* overlies the containers CB1, CB2, CB3, CB4. As such, the front attachment panel 131*a* and the back attachment panel cooperate to form a top panel of the package 110/carrier 105. Further downward positioning of the attachment panels 131*a*, 131*b* over the plurality of containers CA1, CA2, CA3, CA4, CB1, CB2, CB3, CB4 can activate the respective container retention portions 135*a*, 135*b* to engage respective containers.

For example, as the front attachment panel 131*a* is lowered or urged downwardly onto the containers CA1, CA2, CA3, CA4 the container retention portion 135*a* can at least partially separate from the remainder of the front attachment panel 131*a* and the marginal portions 136*a*, 138*a* of the attachment panel 131*a* can fold at least partially downwardly at the respective fold lines 137*a*, 139*a*.

In such an arrangement, upper or top portions T of the respective containers CA1, CA2, CA3, CA4 can extend at least partially through respective openings formed by the respective cuts 141*a* such that the container retention tabs 148*a* can engage, for example, a recessed portion of a rim or other top structure of the respective container CA1, CA2, CA3, CA4 and such that a plurality of reconfigurable edges of the exterior marginal portion 138*a* can engage, for example, a rolled rim edge or other top structure of the respective container CA1, CA2, CA3, CA4.

Furthermore, the container openings 142*a* can at least partially receive the top portions of the respective containers CA1, CA2, CA3, CA4 therethrough such that edge portions of the exterior marginal portion 138*a* adjacent the container openings 142*a* can engaged a rolled rim or other top structure of the respective containers CA1, CA2, CA3, CA4.

In this regard, the top portions T of the respective containers CA1, CA2, CA3, CA4 can protrude through/be partially exposed through the respective container openings 142*a* so as to be visible by a customer or operator.

The back attachment panel 131*b* can engage the containers CB1, CB2, CB3, CB4 in a manner similar to that described above with regard to the engagement of the front attachment panel 131*a* with the containers CA1, CA2, CA3, CA4.

Figure 3:
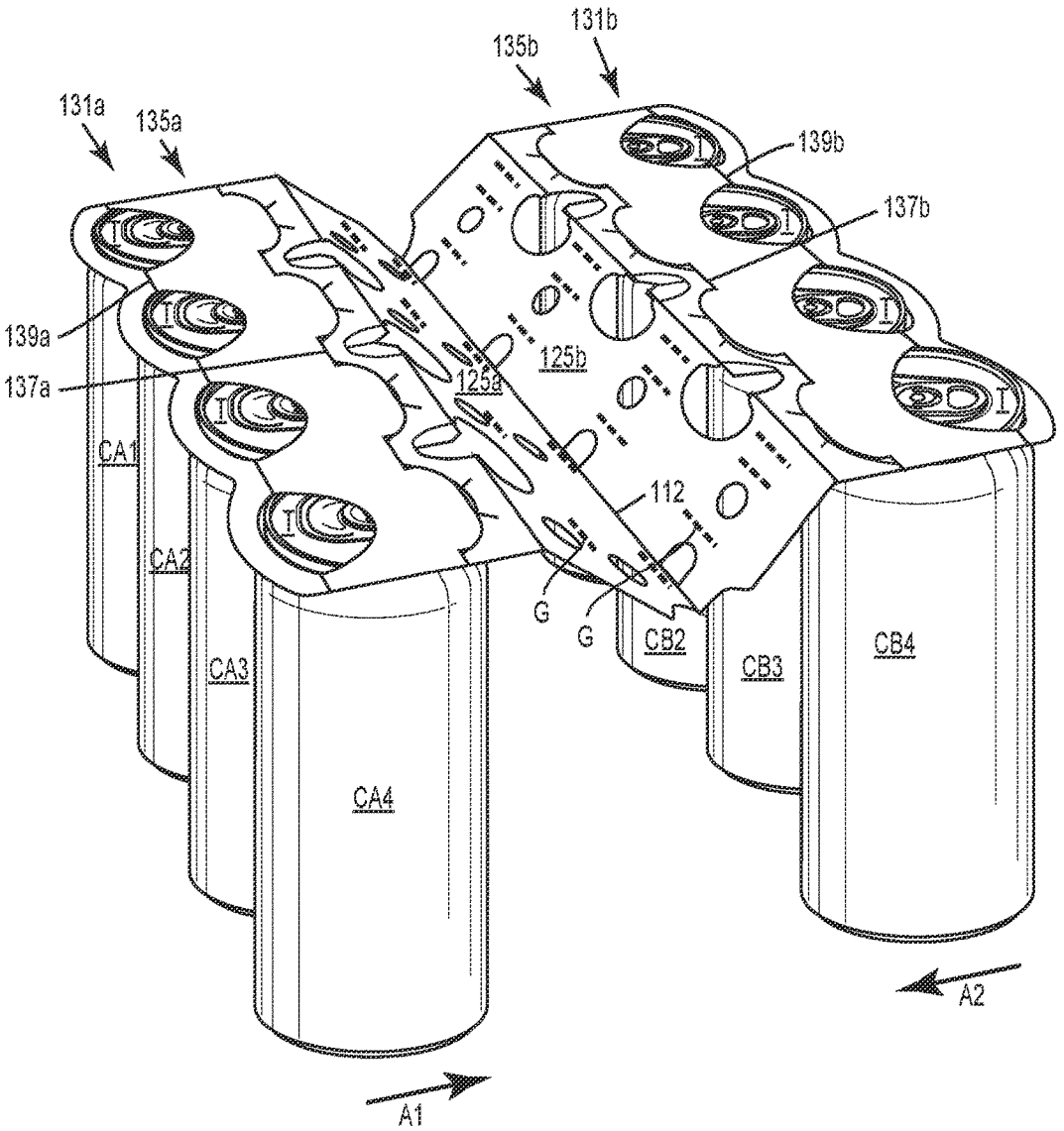
FIG. 3 is a perspective view of another partially folded configuration of a carrier formed from the blank of FIG. 1 according to the first exemplary embodiment.

Still referring to FIG. 2, and with additional reference to FIG. 3, the front central panel 125*a* and the back central panel 125*b* can be folded at the fold line 112 such that the front central panel 125*a* and the back central panel 125*b* are brought into at least partial face-to-face contact in the direction of the respective arrows A1, A2 to be positioned between respective adjacent containers and such that the respective glue openings 127*a* and glue openings 128, 127*b* are positioned so as to be laterally aligned but longitudinally offset due to the different relative spacing of the respective rows RF1, RF2 of respective front glue openings 127*a* and the respective rows RB1, RB2 of respective back glue openings 128, 127*b* away from the fold line 112/lateral centerline CL as described above.

Figure 4:
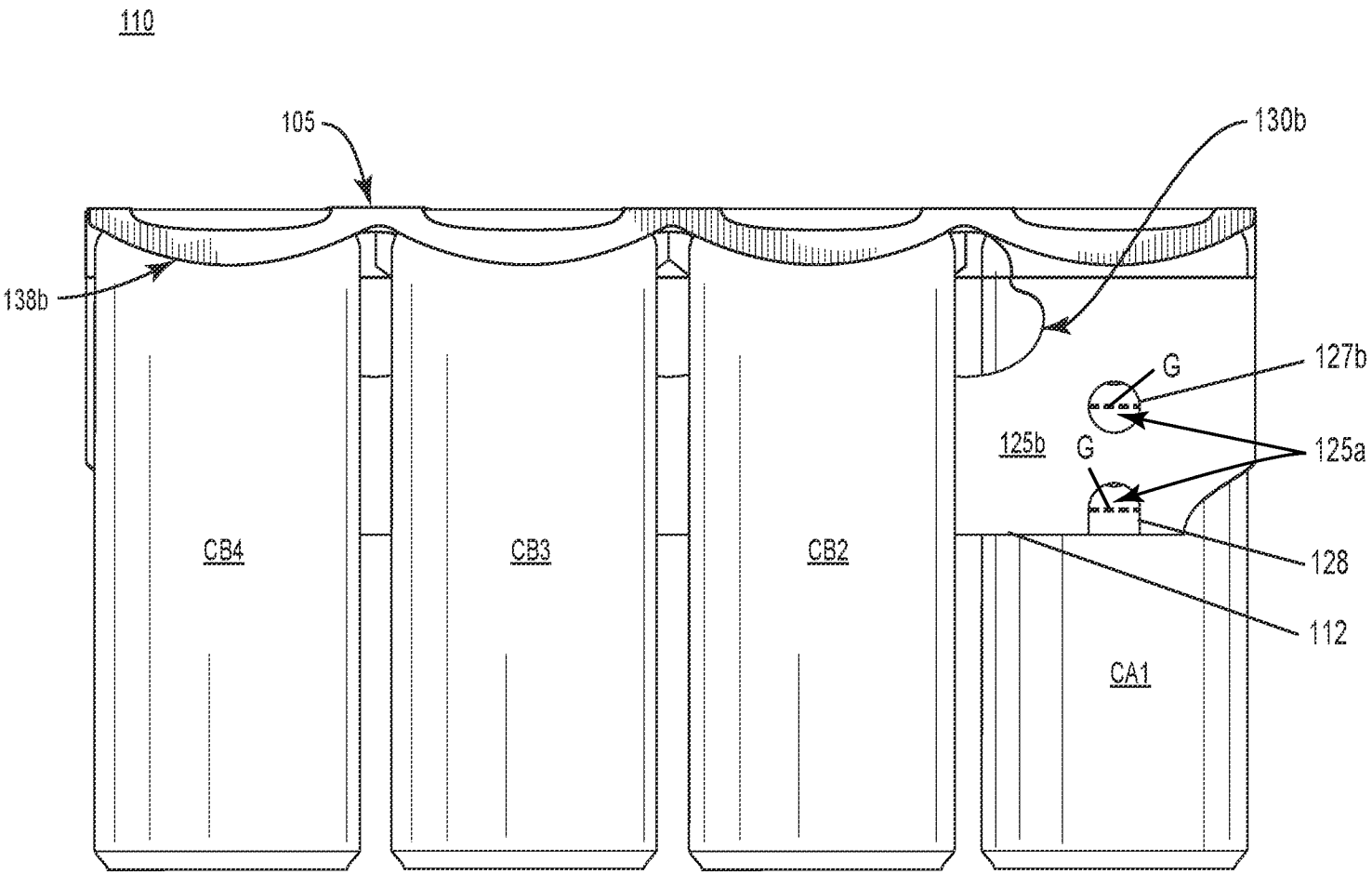
FIG. 4 is a front view of a carrier formed from the blank of FIG. 1 according to the first exemplary embodiment and having a container removed therefrom.
Figure 5:
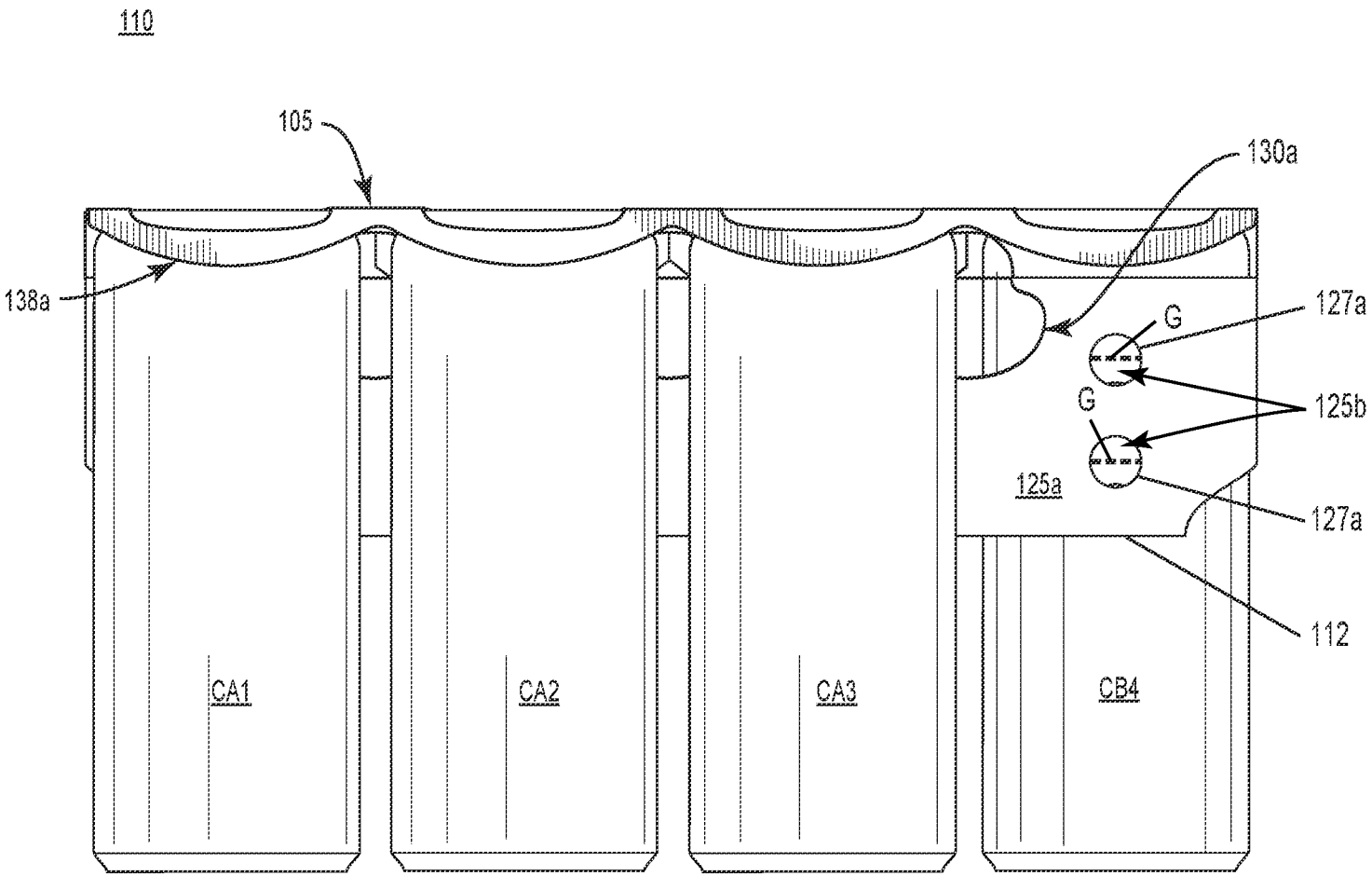
FIG. 5 is a rear view of the carrier of FIG. 4 and having a container removed therefrom.

In this regard, and as shown in FIGS. 4 and 5, the central panels 125*a*, 125*b* are arranged such that a portion of the front central panel 125*a* overlaps each of the glue openings 128, 127*b* and a portion of the back central panel 125*b* overlaps each of the glue openings 127*a* to provide communication between the central panels 125*a*, 125*b* and respective surfaces upon which the respective containers CA1, CA2, CA3, CA4, CB1, CB2, CB3, CB4 can be adhered or otherwise attached, as described further herein. Such rearrangement of the central panels 125*a*, 125*b* can also cause the respective central panels 125*a*, 125*b* to be folded downwardly relative to the respective attachment panels 131*a*, 131*b* at the respective fold lines 133*a*, 133*b*.

An adhesive glue G can be provided to adhere the containers CA1, CA2, CA3, CA4 to respective portions of the central panel 125*b* exposed through the respective glue openings 127*a* and the glue G can be provided to adhere the containers CB1, CB2, CB3, CB4 to respective portions of the central panel 125*a* exposed through the respective glue openings 128, 127*b*. The arrangement of multiple rows of respective glue openings 127*a*, 127*b*, 128 provides multiple points of attachment of each respective container to the respective opposite central panel 125*a*, 125*b* such that each container is provided with a robust attachment to a respective central panel 125*a*, 125*b*. Furthermore, the exposure of the glue G through the respective glue openings 127*a*, 127*b*, 128 upon folding of the central panels 125*a*, 125*b* into face-to-face contact allows for the application of glue G to a common surface, e.g., the interior surface, of the blank 103, and obviates the need to separately glue the exterior surfaces of the central panels 125*a*, 125*b* after folding.

With reference to FIG. 6, the attachment of the containers CA1, CA2, CA3, CA4, CB1, CB2, CB3, CB4 to the respective central panel 125*a*, 125*b* can provide retention and support of the respective containers, e.g., such that the containers do not detach from the carrier 105 under their own weight, in addition to or alternative to the container retention and support provided by the respective container retention portions 135*a*, 135*b*. For example, in one embodiment, one or more of the containers CA1, CA2, CA3, CA4, CB1, CB2, CB3, CB4 can be attached to a respective central panel 125*a*, 125*b* with glue G, without additional retention and support provided by a container retention portion as described above.

Such enhanced attachment of the respective containers to the respective central panels 125*a*, 125*b* with the glue G can also provide enhanced integrity to the carrier 105, e.g., by providing opposing adhesive forces on the respective central panels 125*a*, 125*b* such that the central panels 125*a*, 125*b* are compressed therebetween. For example, in one embodiment, as the carrier 105 is lifted, the containers CA1, CA2, CA3, CA4 can at least partially pull the portions of the back central panel 125*b* to which they are attached through the respective glue openings 127*a* toward the front central panel 125*a* under the at least partial weight of the containers CA1, CA2, CA3, CA4. Respective portions of the front central panel 125*a* can be pulled toward the back central panel 125*b* through the respective glue openings 128, 127*b* by the containers CB1, CB2, CB3, CB4 in a similar manner.

The glue G described herein can be, for example, a hot melt adhesive, a high tack glue, an epoxy, a polymeric cement, etc., or combinations thereof. The glue G can have a different arrangement without departing from the disclosure. For example, in one embodiment, the glue G can be applied to one or more portions of the interior surface of the blank 103/carrier 105.

In another embodiment, the glue G can have a foam or foamed configuration, e.g., such that pockets of fluids such as gas are interspersed with solid, semi-solid, and/or liquid components of adhesive. In this regard, the glue G can be injected/infused with a fluid, e.g., gaseous, component that influences the glue G to expand from an originally-defined volume, over a change in time, to occupy a larger volume. In one embodiment, the glue G can comprise about 50% solid/semi-solid/liquid adhesive and about 50% gaseous components.

In other embodiments, the glue G can comprise a different ratio of adhesive to gaseous components, for example, about 10% adhesive/about 90% gaseous components, about 20% adhesive/about 80% gaseous components, about 30% adhesive/about 70% gaseous components, about 40% adhesive/about 60% gaseous components, about 60% adhesive/about 40% gaseous components, about 70% adhesive/about 30% gaseous components, about 80% adhesive/about 20% gaseous components, about 90% adhesive/about 10% gaseous components, or other integer or non-integer percentage ratios therebetween. The glue G can be any suitable adhesive without departing from the disclosure.

Figure 7:
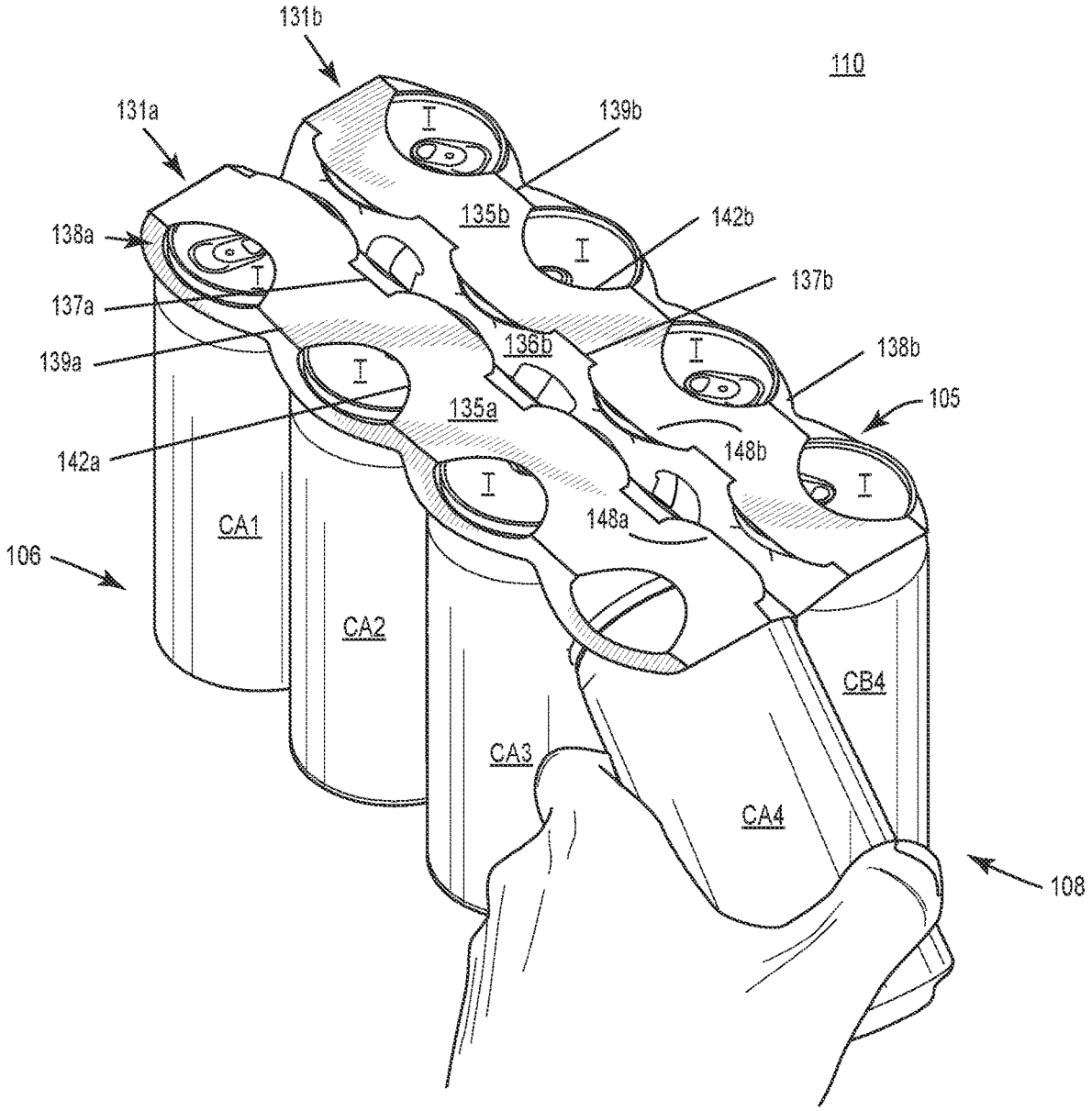
FIG. 7 is another perspective view of the package and carrier of FIG. 6 and showing a container being removed therefrom.

With additional reference to FIG. 7, upon formation of the package 110/carrier 105, respective containers CA1, CA2, CA3, CA4, CB1, CB2, CB3, CB4 can be removed from the carrier 105 by disengaging the container from a respective attachment panel 131*a*, 131*b*, for example, by withdrawing the top portion T of a respective container through an opening formed by a respective cut 141*a*, 141*b* and a respective container opening 142*a*, 142*b* along the respective attachment panel 131*a*, 131*b*, and peeling the respective container away from the respective central panel 125*a*, 125*b*.

Peeling or pulling the containers CA1, CA2, CA3, CA4, CB1, CB2, CB3, CB4 away from a respective central panel 125*a*, 125*b* can involve pulling the respective container with a force sufficient to overcome the adhesive bond of the respective container and the respective central panel 125*a*, 125*b* provided by the glue G. In one embodiment, the glue G can be selected so as to remain on a respective central panel 125*a*, 125*b*, e.g., such that substantially little or no glue G remains on the container as it is removed. In one embodiment, one or more of the containers CA1, CA2, CA3, CA4, CB1, CB2, CB3, CB4 can be reattached to a respective central panel 125*a*, 125*b* following therefrom by pressing the container against a respective region of glue G.

It will be understood that a different number of rows or arrangements of glue openings can be provided without departing from the disclosure, and that the central panels can be sized and configured to accommodate such arrangements. In one embodiment, the central panels 125*a*, 125*b* can be devoid of glue openings such that the respective containers CA1, CA2, CA3, CA4 and CB1, CB2, CB3, CB4 are adhered only to the respective central panel 125*a*, 125*b*. In another embodiment, glue G can be provided both on portions of the respective central panels 125*a*, 125*b* exposed through the respective glue openings 128, 127*b* and glue openings 127*a* as well as portions of the respective central panels 125*a*, 125*b* adjacent the respective glue openings such that each container CA1, CA2, CA3, CA4, CB1, CB2, CB3, CB4 can be adhered to portions of both central panels 125*a*, 125*b*.

The package 110/carrier 105 can be grasped by a consumer by inserting one or more of his or her fingers in one or more of the both handle openings 130*a*, 132*a*, 130*b*, 132*b* and engaging, for example, a portion of an underside of a respective attachment panel 131*a*, 131*b* and/or an edge of the respective handle openings 130*a*, 130*b*, 132*a*, 132*b*. The respective handle openings 130*a*, 132*a*, 130*b*, 132*b* can be configured so as to provide a consumer multiple edges and surfaces by which to engage and lift the carrier 105 such that the consumer can engage the carrier from multiple orientations, e.g., a lateral orientation or a longitudinal orientation, or orientations therebetween.

In one embodiment, the handle reinforcement tabs 161*a*, 161*b*, 165*a*, 165*b* provide increased support of the package 110/carrier 105 when the package/carrier is grasped by the consumer though the handle openings 130*a*, 132*a*, 130*b*, 132*b*. The handle reinforcement tabs 161*a*, 161*b*, 165*a*, 165*b* can be folded under and provide an extra layer to reinforce the package 110/carrier 105 and prevent tearing at the handle openings 130*a*, 130*b*, 132*a*, 132*b*. In addition, one or more portions of the respective handle reinforcement tabs 161*a*, 165*a*, 161*b*, 165*b* can fold downwardly at one or more of the respective fold lines 163*a*, 169*a*, 163*b*, 169*b* upon engagement with one or more of a user's fingers, for example, to provide a buffer or protective layer of material to protect a user's finger in the course of gripping the carrier 105 and/or to provide separation among adjacent containers.

The carrier 105/package 110 described above has a compact structure that can, for example, provide materials savings and waste reduction. Additionally, the arrangement of the glue G among the containers CA1, CA2, CA3, CA4, CB1, CB2, CB3, CB4 provides multiple points of attachment that results in a robust structure for holding and carrying the containers CA1, CA2, CA3, CB1, CB2, CB3, CB4. Further, the exposure of one or more portions of the containers CA1, CA2, CA3, CA4, CB1, CB2, CB3, CB4 on exterior portions of the package 110/carrier 105 as well as exposure of the top portions T of the respective containers through the container openings 142*a*, 142*b* provides a consumer with a clear view of labeling or surface graphics associated with the containers CA1, CA2, CA3, CA4, CB1, CB2, CB3, CB4 as well as providing convenient access to remove one or more of the containers CA1, CA2, CA3, CA4, CB1, CB2, CB3, CB4 from the carrier 105/package 110.

Figure 8:
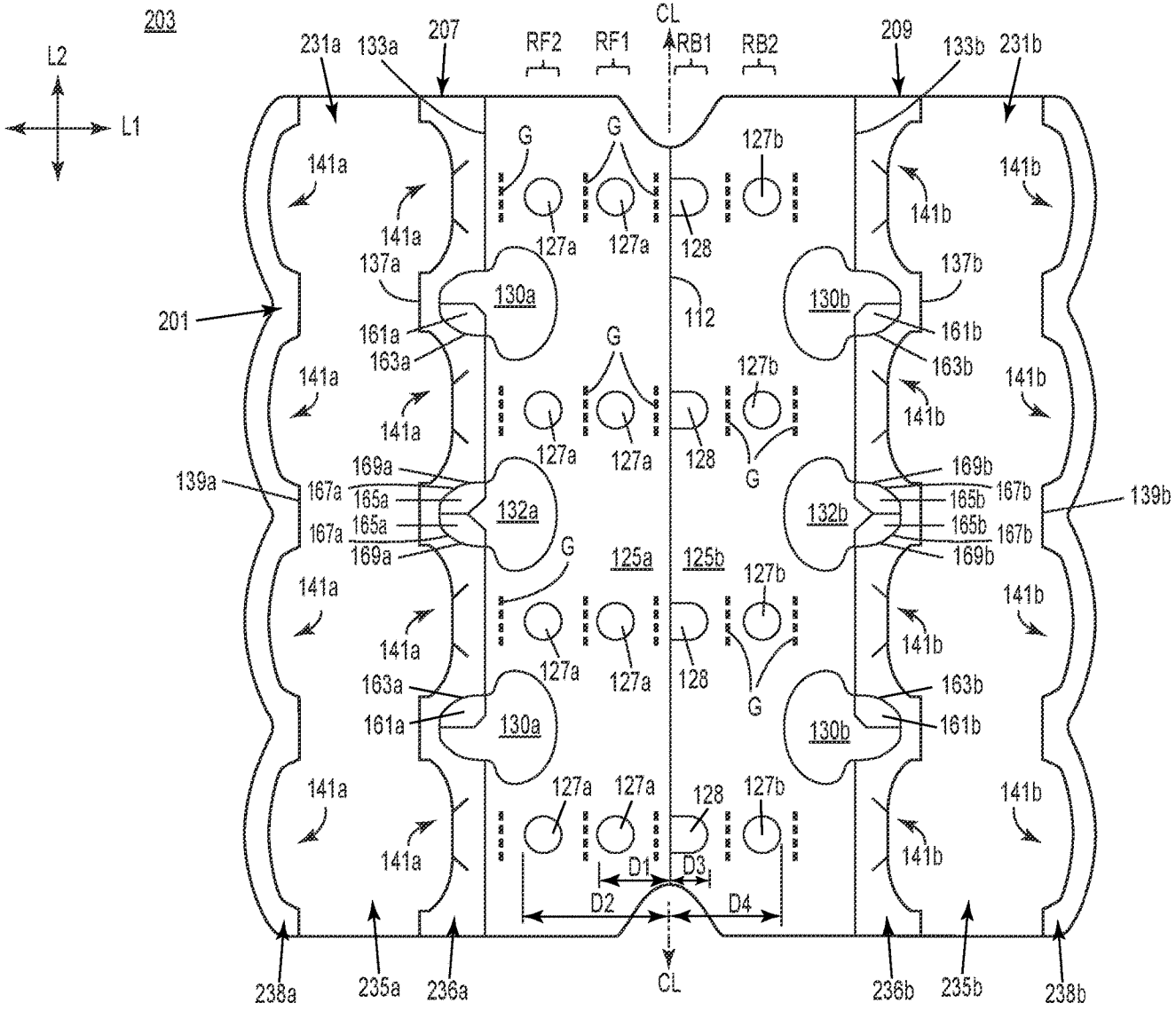
FIG. 8 is a schematic plan view of an outer surface of a blank for forming a carrier according to a second exemplary embodiment of the disclosure.
Figure 9:
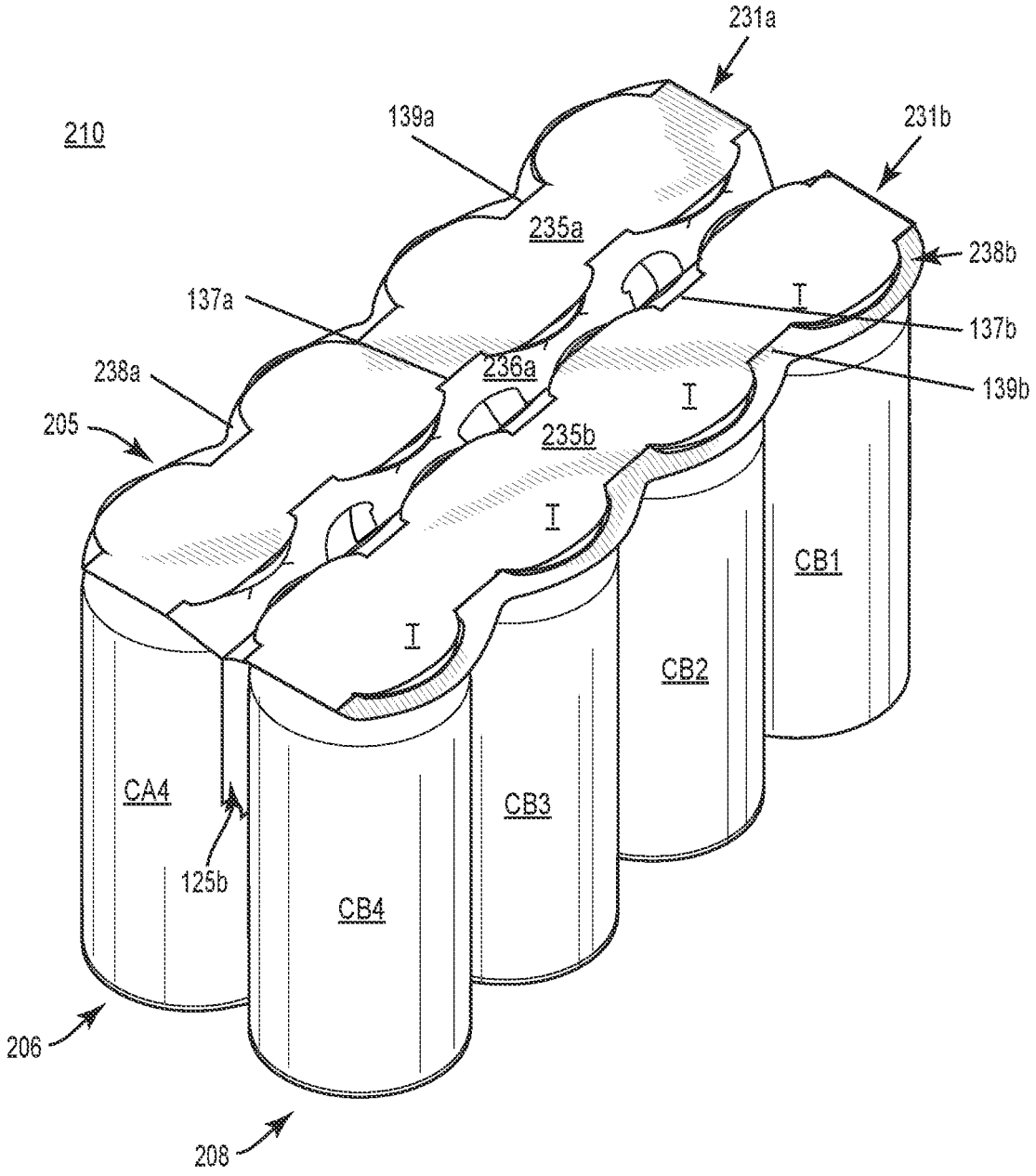
FIG. 9 is a perspective view of a package and carrier formed from the blank of FIG. 8 according to the second exemplary embodiment.

FIG. 8 is a plan view of the exterior side 201 of a blank, generally indicated at 203, used to form a carrier 205 (FIG. 9) for containing one or more containers according to a second exemplary embodiment of the disclosure. The blank 203 and the carrier 205 formed therefrom can have one or more substantially similar features to the blank 103 and the carrier 105 described above, and like or similar components are referenced with like or similar reference numbers. The carrier 205 formed from the blank 203 can be provided with one or more containers as a package 110 (FIG. 9).

As shown, the blank 203 includes a front portion 207 for forming a front portion 206 of the carrier 205 and a back portion 209 for forming a back portion 208 of the carrier 205.

Figure 8B:
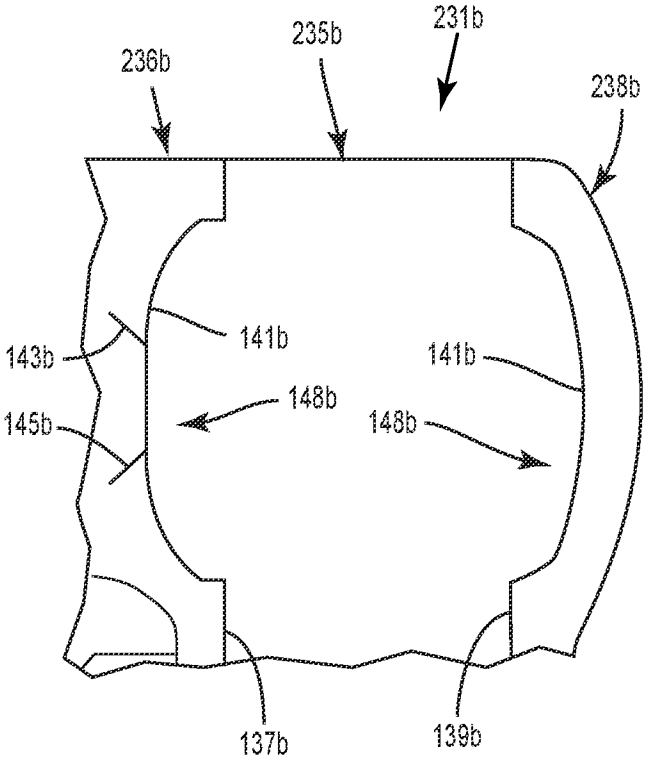
FIG. 8B is an enlarged view of another portion of the blank of FIG. 8.
Figure 8A:
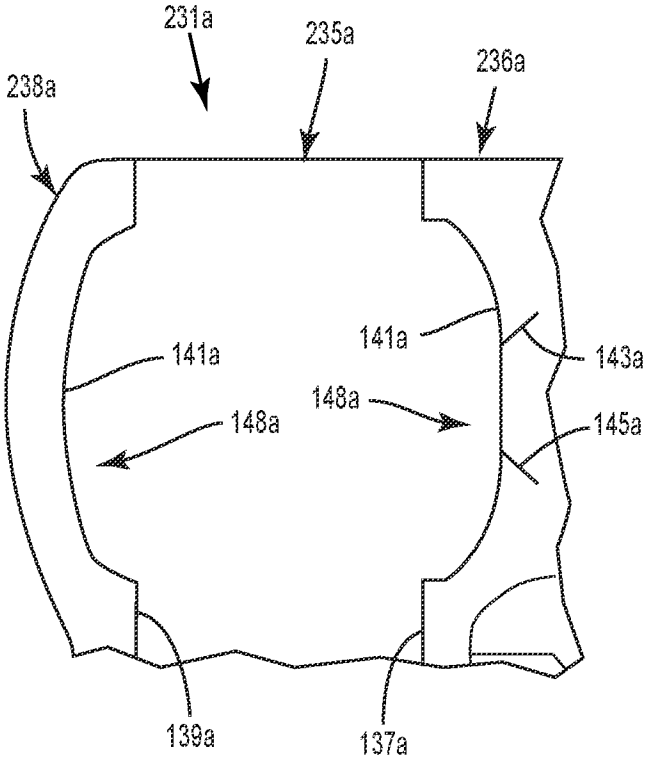
FIG. 8A is an enlarged view of a portion of the blank of FIG. 8.

The blank 203 can have an attachment panel 231*a* that is generally similar to the attachment panel 131*a* described above, except that the fold line 139*a* is interrupted by a second plurality of laterally spaced cuts 141*a* instead of the container openings 142*a*. The laterally spaced cuts 141*a* that interrupt the fold line 139*a* can be free from intersection with oblique cuts 143*a*, 145*a*, as shown, though the oblique cuts 143*a*, 145*a* could be included without departing from the disclosure. The features of the attachment panel 231*a* are best shown in FIG. 8A.

In this regard, the attachment panel 231*a* of the blank 203 has a container retention portion 235*a* defined between the fold lines 137*a*, 139*a* that is free from the container openings 142*a* such that top portions T of the containers engaged by the attachment panel 231*a* are covered by a larger area of the material that forms the blank 203/carrier 205 than described above with regard to the blank 103/carrier 105.

The back portion 209 of the blank 203 includes a back central panel 125*b* and a back container retention panel or back attachment panel 231*b* having associated features that are generally a mirror-image of the corresponding panels and flaps of the front portion 207 of the blank 203. Corresponding components (e.g., panels, flaps, fold lines, cuts, etc.) have been designated by corresponding reference numbers that differ by the "a" or "b" suffix, with the "a" components corresponding to the front portion 207 of the blank 203 and the "b" components corresponding to the back portion 209 of the blank 203. The features of the attachment panel 231*a* are best shown in FIG. 8B.

Referring additionally to FIG. 9, the carrier 205 and a package 210 that includes the carrier 205 and the containers CA1, CA2, CA3, CA4, CB1, CB2, CB3, CB4 can be formed in a similar manner as that described above with respect to the carrier 105/package 110.

With regard to the container retention features of the carrier 205, the upper or top portions T of the respective containers CA1, CA2, CA3, CA4 can be at least partially received through openings formed by the respective cuts 141*a* such that the plurality of reconfigurable edges of the interior marginal portion 236*a* provided by the cuts 141*a*, 143*a*, 145*a* and the generally continuous edges of the exterior marginal portion 238*a* provided by the cuts 141*a* can engage a rolled rim or other top structure of the respective container CA1, CA2, CA3, CA4 in the manner described above with regard to the carrier 105.

The attachment panel 231*b* can engage the containers CB1, CB2, CB3, CB4 in a manner similar to that described above with regard to the engagement of the attachment panel 231*a* with the containers CA1, CA2, CA3, CA4.

The carrier 205/package 210 provides the same or similar advantages to those described above with respect to the carrier 105/package 110, such as materials savings and waste reduction, in a construct that provides multiple points of adhesive attachment of the material of the blank 203/carrier 205 to the respective containers, e.g., at the central panels 125*a*, 125*b*, in addition to the support provided to the containers via engagement with the container retention features of the attachment panels 231*a*, 231*b*.

The carrier 205/package 210 can be provided in a different configuration without departing from the disclosure. For example, in one embodiment, a carrier/package can be provided having a front portion or back portion corresponding to that of the carrier 105/package 110 and having the other of the front portion or back portion corresponding to that of the carrier 205/package 210.

Figure 10:
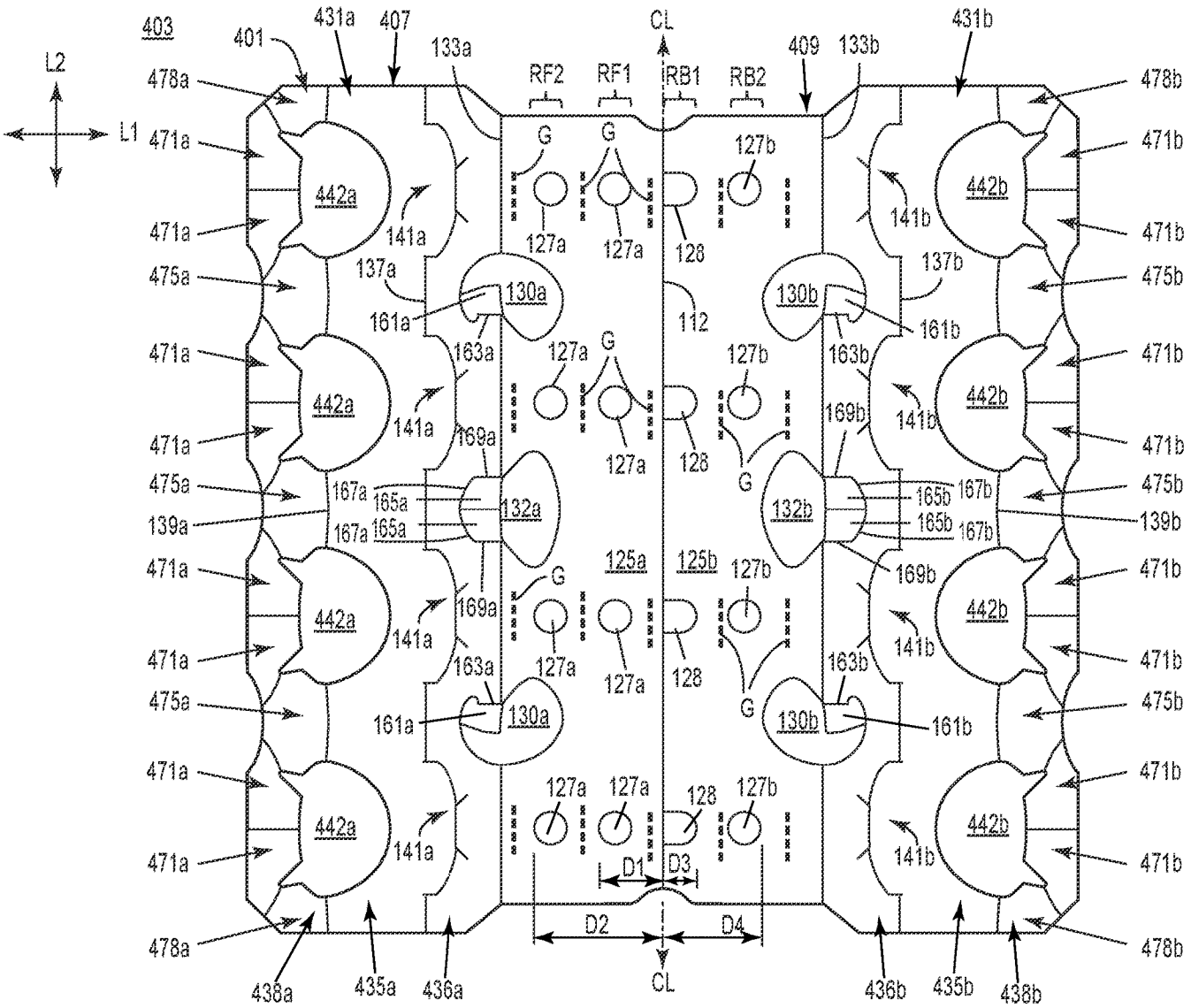
FIG. 10 is a schematic plan view of an outer surface of a blank for forming a carrier according to a third exemplary embodiment of the disclosure.
Figure 11:
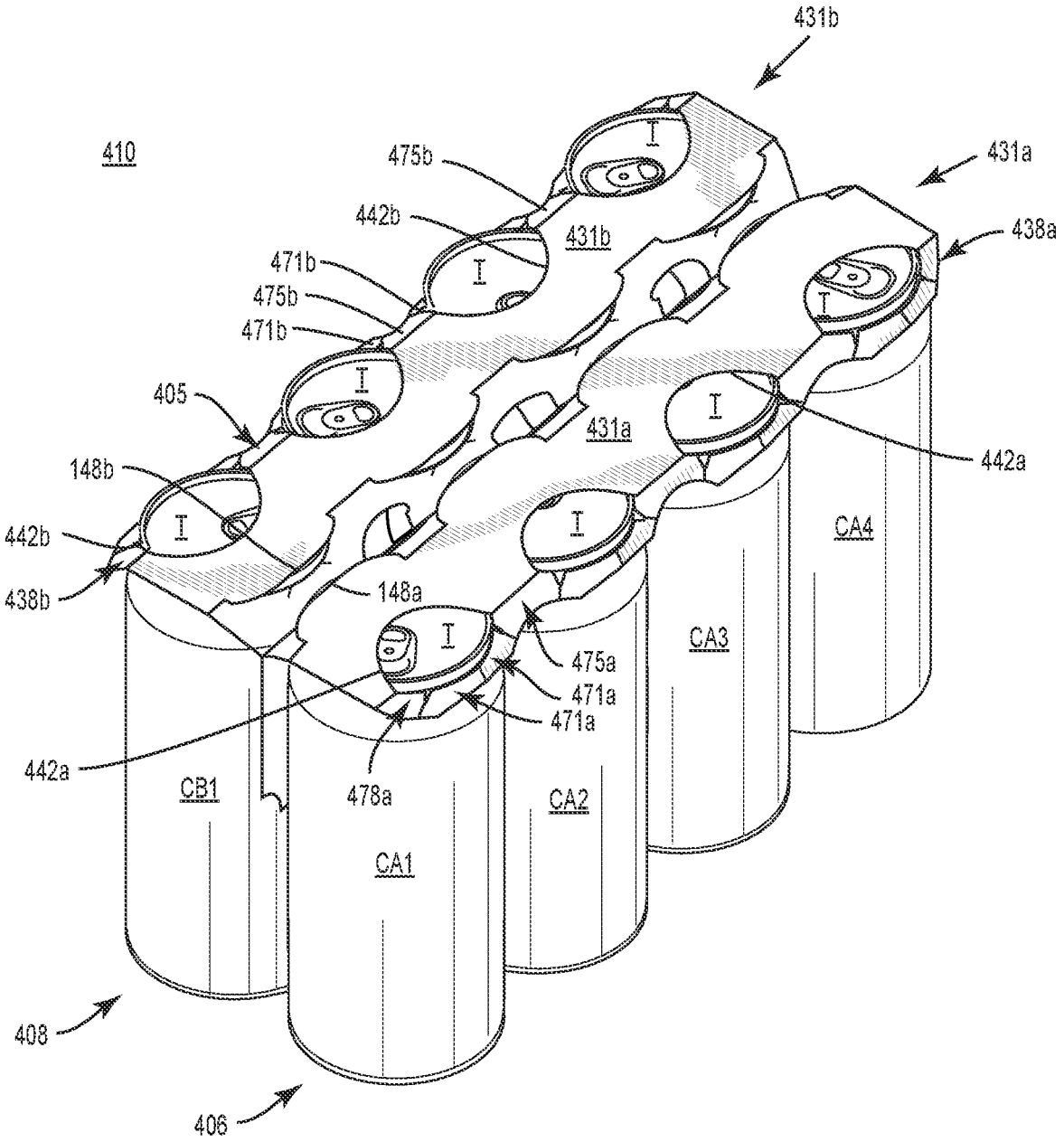
FIG. 11 is a perspective view of a package and carrier formed from the blank of FIG. 10 according to the third exemplary embodiment.

FIG. 10 is a plan view of the exterior side 401 of a blank, generally indicated at 403, used to form a carrier 405 (FIG. 11) for containing one or more containers according to a third exemplary embodiment of the disclosure. The blank 403 and the carrier 405 formed therefrom can have one or more substantially similar features to the blanks 103, 203 and the carriers 105, 205 described above, and like or similar components are referenced with like or similar reference numbers. The carrier 405 formed from the blank 403 can be provided with one or more containers as a package 410 (FIG. 11).

As shown, the blank 403 includes a front portion 407 for forming a front portion 406 of the carrier 405 and a back portion 409 for forming a back portion 408 of the carrier 405.

The front portion 407 of the blank 403 includes a front attachment panel 431*a* having a container retention portion 435*a* defined between the pair of lateral fold lines 137*a*, 139*a*. In this regard, an interior marginal portion 436*a* of the attachment panel 431*a* is defined between the fold line 137*a* and the fold line 133*a*, and an exterior marginal portion 438*a* of the attachment panel 431*a* is defined between the fold line 139*a* and a lateral free edge of the attachment panel 431*a*.

Figure 10B:
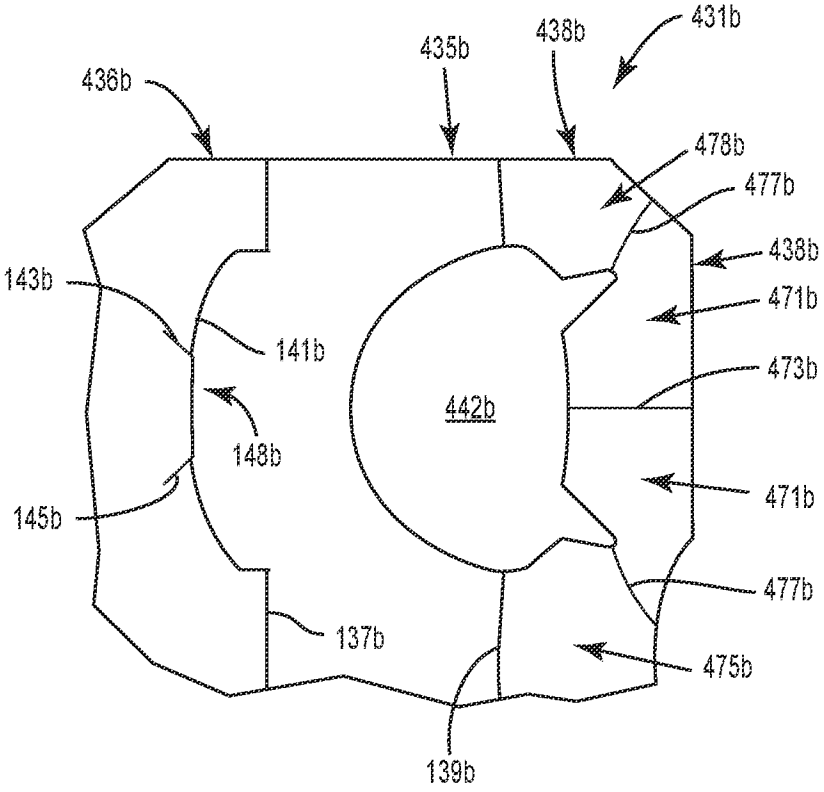
FIG. 10B is an enlarged view of another portion of the blank of FIG. 10.
Figure 10A:
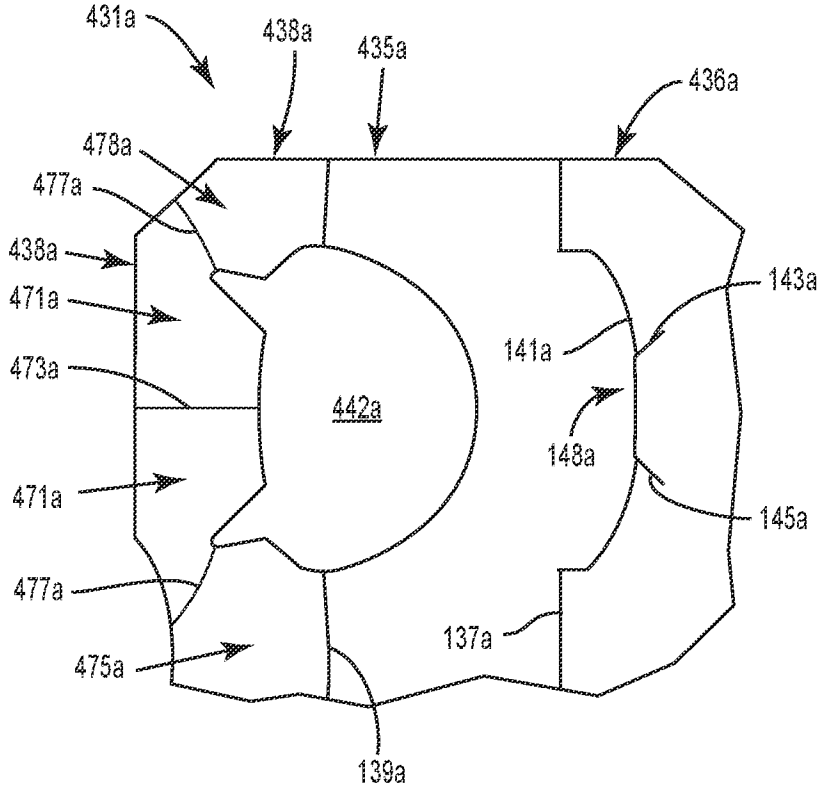
FIG. 10A is an enlarged view of a portion of the blank of FIG. 10.

With additional reference to FIG. 10A, the attachment panel 431*a* can include container retention features that include a plurality of the laterally spaced cuts 141*a* interrupting the fold line 137*a* and a plurality of container openings 442*a* interrupting the fold line 139*a*.

The laterally spaced cuts 141*a*, as shown, can include one or more curved, straight, and/or angled portions to define the respective container retention tabs 148*a*. A pair of the oblique cuts 143*a*, 145*a* can extend from a central portion of the curved cuts 141*a* to define a plurality of reconfigurable edges of the interior marginal portion 436*a* of the attachment panel 431*a*.

The container openings 442*a*, as shown, have an at least partially circular profile, and can have one or more irregular edges defined by longitudinally inner free edges of a plurality of container engagement portions of the exterior marginal portion 438*a* of the attachment panel 431*a*.

Still referring to FIG. 10A, the exterior marginal portion 438*a* of the attachment panel 431*a* includes respective pairs of container engagement portions 471*a*, adjacent container engagement portions 471*a* foldably connected to one another at a respective longitudinal fold lines 473*a*. The laterally inner free edges of the container engagement portions 471*a* at least partially form an edge of the respective container openings 442*a*.

Each container engagement portion 471*a* is foldably connected to a respective connector portion 475*a* of the exterior marginal portion 438*a* of the attachment panel 431*a* at respective oblique fold lines 477*a*, and each connector portion 475*a* is foldably connected to a respective portion of the lateral fold line 139*a*. As also shown, connector portions 478*a* can be foldably connected to the laterally outermost container engagement portions 471*a* of the exterior marginal portion 438*a* of the attachment panel 431*a*, and may have a generally truncated or smaller configuration relative to the connector portions 475*a*. In one embodiment, the connector portions 478*a* can be considered container engagement portions.

In the illustrated embodiment, the back portion 409 of the blank 403 includes a back central panel 125*b* and a back container retention panel or back attachment panel 431*b* having associated features that are generally a mirror-image of the corresponding panels and flaps of the front portion 407 of the blank 403. Corresponding components (e.g., panels, flaps, fold lines, cuts, etc.) have been designated by corresponding reference numbers that differ by the "a" or "b" suffix, with the "a" components corresponding to the front portion 407 of the blank 403 and the "b" components corresponding to the back portion 409 of the blank 403. The features of the attachment panel 431*a* are best shown in FIG. 10B.

Referring additionally to FIG. 11, the carrier 405 and a package 410 that includes the carrier 405 and the containers CA1, CA2, CA3, CA4, CB1, CB2, CB3, CB4 can be formed in a similar manner as that described above with respect to the carrier 105/package 110 and the carrier 205/package 210.

With regard to the container retention features of the attachment panel 431*a*, as the front attachment panel 431*a* is lowered or urged downwardly onto the containers CA1, CA2, CA3, CA4, the upper or top portions T of the respective containers CA1, CA2, CA3, CA4 can be at least partially received through respective openings formed by the respective cuts 141*a* in the front attachment panel 431*a*. During such movement, the container retention tabs 148*a* can contact the top portions T of respective containers so as to engage a portion thereof, e.g., a recessed top portion/rim of the respective containers. Further, the flexibly reconfigurable edges of the interior marginal portion 436*a* of the attachment panel 431*a* formed by the cuts 141*a*, 143*a*, 145*a* can be positioned to engage, for example, a rolled rim edge or other top structure of the respective container CA1, CA2, CA3, CA4.

In addition, the container openings 442*a* can at least partially receive the top portions of the respective containers CA1, CA2, CA3, CA4 therethrough. Such engagement of the containers CA1, CA2, CA3, CA4 and the attachment panel 431*a* can also cause the exterior marginal portion 438*a* of the attachment panel 431*a* to fold at least partially downwardly at the fold line 139*a* to position the container engagement portions 471*a* to fold relative to each other at the fold line 473*a* and to fold relative to the respective connector portions 475*a*, at the respective oblique fold lines 477*a*, and can further be folded at least partially downwardly at respective portions of the fold line 139*a*.

In the illustrated arrangement, the container engagement portions 477*a* of the exterior marginal portion 438*a* are obliquely arranged relative to one another and obliquely downwardly arranged relative to the remainder of the attachment panel 431*a* such that the longitudinally inner free edges of the container engagement portions 471*a* are positioned to contact or engage a rolled rim or other top structure of the respective containers CA1, CA2, CA3, CA4.

In this regard, the top portions T of the respective containers CA1, CA2, CA3, CA4 can protrude through/be partially exposed through the respective container openings 442*a* so as to be visible by a customer or operator.

The attachment panel 431*b* can engage the containers CB1, CB2, CB3, CB4 in a manner similar to that described above with regard to the engagement of the attachment panel 431*a* with the containers CA1, CA2, CA3, CA4.

The carrier 405/package 410 provides the same or similar advantages to those described above with respect to the carrier 105/package 110, the carrier 205/package 210, such as materials savings and waste reduction, in a construct that provides multiple points of adhesive attachment of the material of the blank 403/carrier 405 to the respective containers, e.g., at the central panels 125*a*, 125*b*, in addition to the support provided to the containers via engagement with the container retention features of the attachment panels 431*a*, 431*b*. Such a configuration also exposes portions of the containers on exterior portions of the carrier 405/package 410, e.g., the upper portions T of the respective containers through the container openings 442*a*, 442*b* for enhanced product visibility.

The carrier 405/package 410 can have a different configuration without departing from the disclosure. For example, in one embodiment, the container openings 442*a* can be replaced by an additional plurality of laterally spaced cuts 142*a*.

Figure 12:
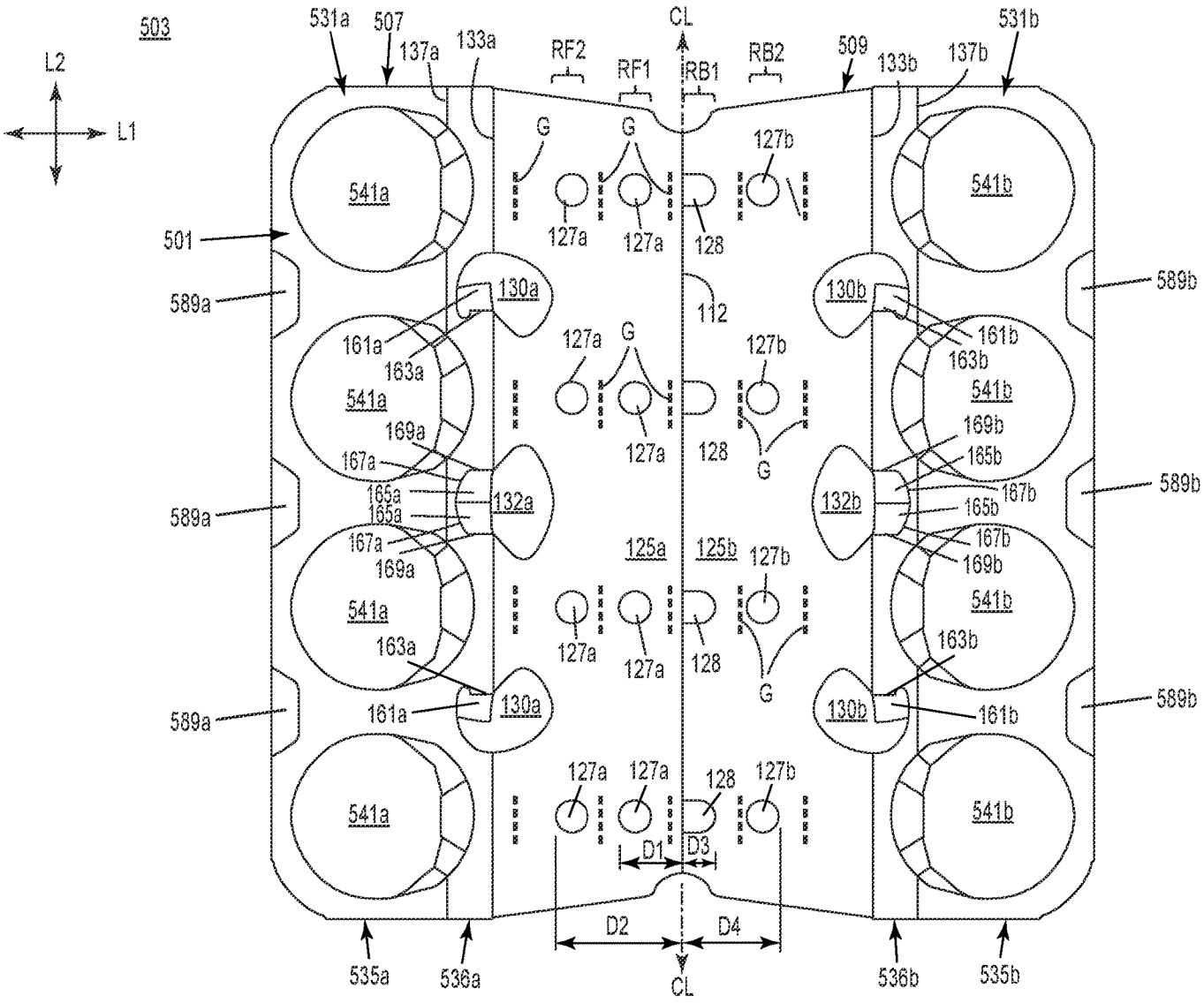
FIG. 12 is a schematic plan view of an outer surface of a blank for forming a carrier according to a fourth exemplary embodiment of the disclosure.
Figure 13:
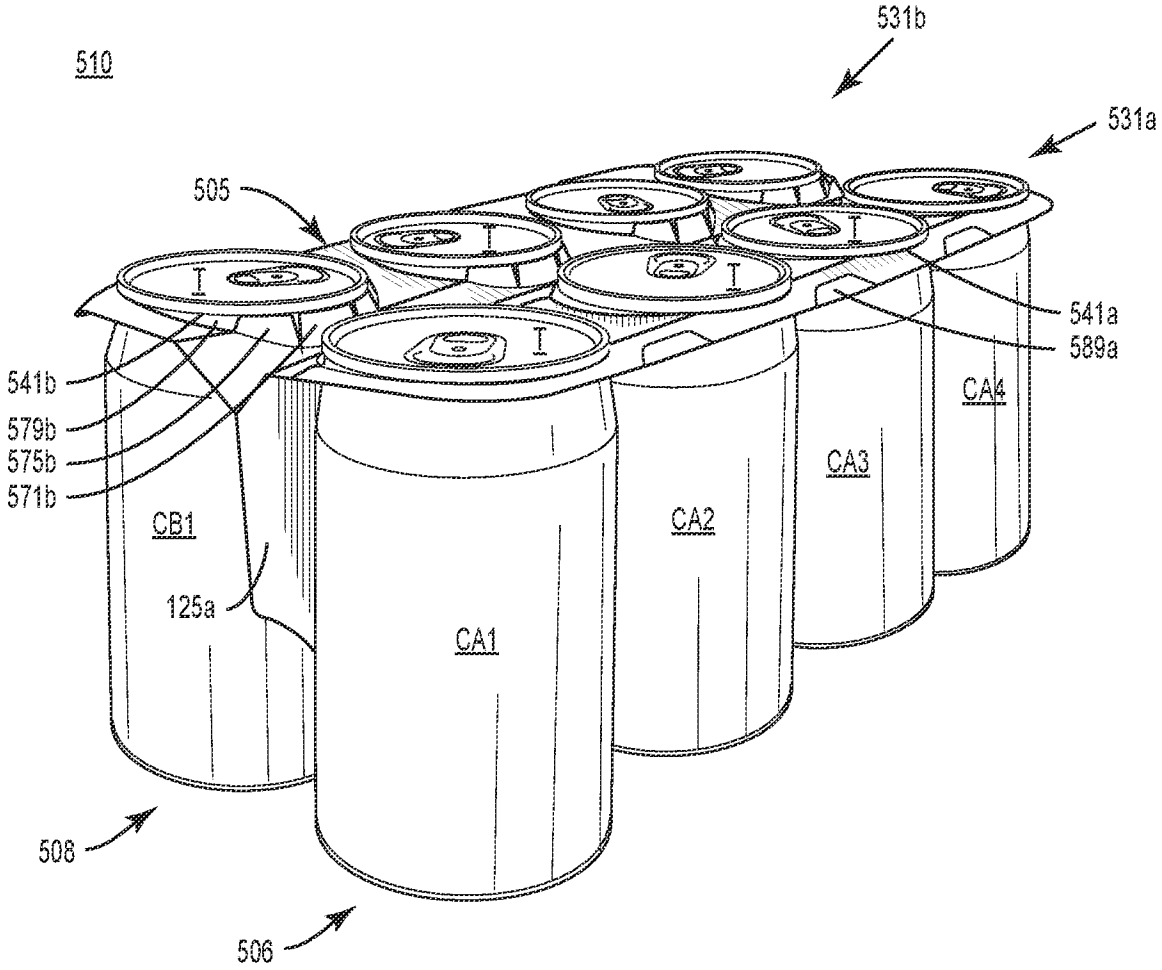
FIG. 13 is a perspective view of a package and carrier formed from the blank of FIG. 12 according to the fourth exemplary embodiment.

FIG. 12 is a plan view of the exterior side 501 of a blank, generally indicated at 503, used to form a carrier 505 (FIG. 13) for containing one or more containers according to a fourth exemplary embodiment of the disclosure. The blank 503 and the carrier 505 formed therefrom can have one or more features that are substantially similar to the blanks 103, 203, 403 and the carriers 105, 205, 405 described above, and like or similar components are referenced with like or similar reference numbers. The carrier 505 formed from the blank 503 can be provided with one or more containers as a package 510 (FIG. 13).

As shown, the blank 503 includes a front portion 507 for forming a front portion 506 of the carrier 505 and a back portion 509 for forming a back portion 508 of the carrier 505. The front portion 507 of the blank 503 includes a front attachment panel 531*a* having a container retention portion 535*a* and an interior marginal portion 536*a* formed between the lateral fold line 137*a* and the fold line 133*a*.

Figure 12B:
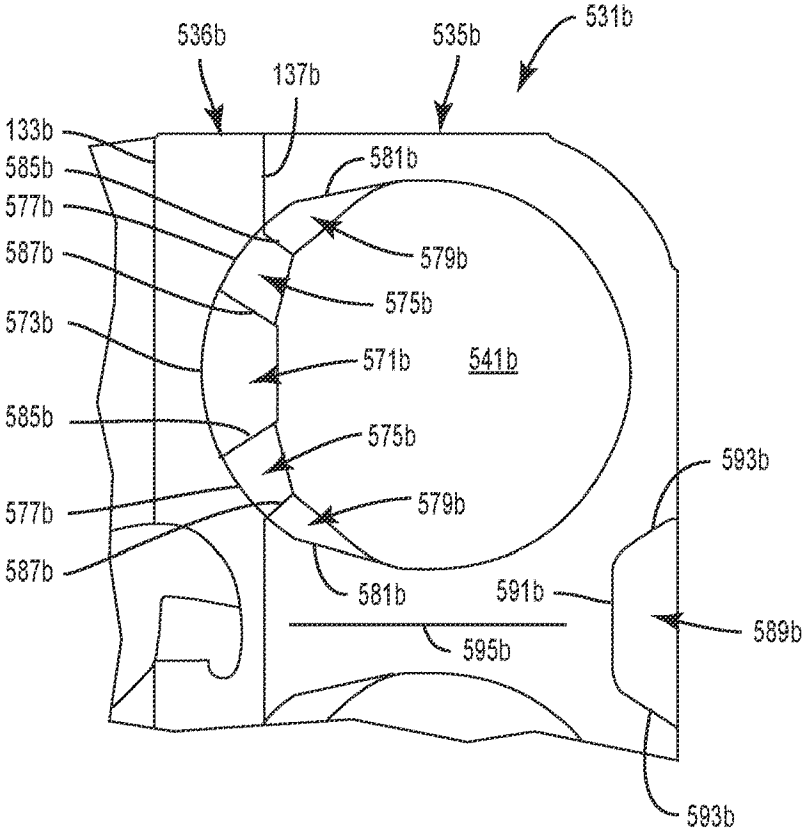
FIG. 12B is an enlarged view of another portion of the blank of FIG. 12.
Figure 12A:
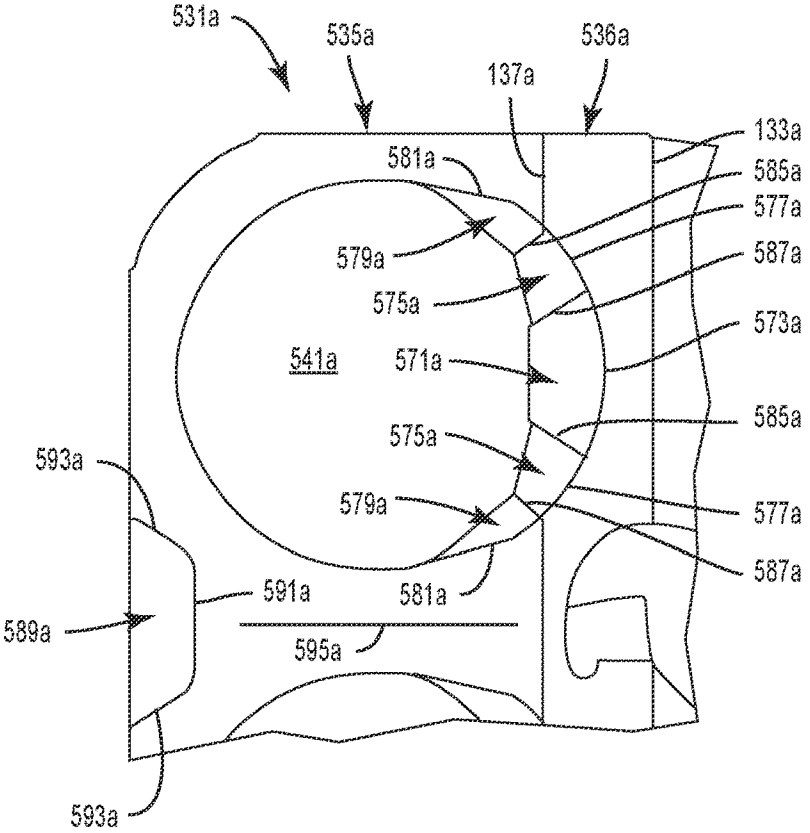
FIG. 12A is an enlarged view of a portion of the blank of FIG. 12.

With additional reference to FIG. 12A, the container retention features of the attachment panel 531*a* include laterally spaced container openings 541*a* that have a generally circular profile. As also shown, a plurality of container retention tabs is foldably connected to the interior marginal portion 536*a* of the attachment panel 531*a*, and are positioned to extend into the respective container openings 541*a*.

The plurality of container retention tabs can include a major, e.g., relatively larger, or first container retention tab 571*a* at least partially foldably connected to the interior marginal portion 536*a* of the attachment panel 531*a* at a line of weakening or fold line 573*a*, a pair of second or intermediate container retention tabs 575*a* radially adjacent the container retention tab 571*a* and foldably connected to the interior marginal portion 536*a* of the attachment panel 531*a* at respective lines of weakening or fold lines 577*a*, and a pair of minor, e.g., relatively smaller, or third container retention tabs 579*a* radially adjacent the respective container retention tabs 575*a* and foldably connected to the interior marginal portion 536*a* of the attachment panel at respective lines of weakening or fold lines 581*a*.

Adjacent container retention tabs 571*a*, 575*a*, 579*a* can be separated from one another at respective cuts 585*a*, 587*a*, as shown. In this regard, the free edges of the container retention tabs 571*a*, 575*a*, 579*a* can at least partially define the container openings 541*a*, and foldable manipulation thereof can cause the container openings 541*a* to expand.

Still referring to FIGS. 12 and 12A, a plurality of relief tabs 589*a* can be foldably connected to the container retention portion 535*a* of the attachment panel 531*a* at respective lateral fold lines 591*a*, and can be separable therefrom at curved or oblique cuts 593*a*. A plurality of longitudinal lines of weakening or fold lines 595*a*, as shown, can also be positioned along the container retention portion 535*a* of the attachment panel 531*a* between respective container openings 541*a*.

In the illustrated embodiment, the back portion 509 of the blank 503 includes a back central panel 125*b* and a back container retention panel or back attachment panel 531*b* having associated features that are generally a mirror-image of the corresponding panels and flaps of the front portion 507 of the blank 503. Corresponding components (e.g., panels, flaps, fold lines, cuts, etc.) have been designated by corresponding reference numbers that differ by the "a" or "b" suffix, with the "a" components corresponding to the front portion 507 of the blank 503 and the "b" components corresponding to the back portion 509 of the blank 503. The features of the attachment panel 531*a* are best shown in FIG. 12B.

Referring additionally to FIG. 13, the carrier 505 and a package 510 that includes the carrier 505 and the containers CA1, CA2, CA3, CA4, CB1, CB2, CB3, CB4 can be formed in a similar manner as that described above with respect to the carrier 105/package 110, the carrier 205/package 210, and the carrier 405/package 410.

With regard to the container retention features of the carrier 505, the upper or top portions T of the respective containers CA1, CA2, CA3, CA4 can be at least partially received through the respective container retention openings 541*a*. During such movement, the container retention tabs 571*a*, 575*a*, 579*a* can contact the top portions T of respective containers so as to be urged to fold at least partially upwardly at the respective fold lines 573*a*, 577*a*, 581*a* so as to be positioned to engage, for example, a rolled rim edge or other top structure of the respective container CA1, CA2, CA3, CA4. In one embodiment, one or more of the container retention tabs 579*a* can fold/flex upwardly to facilitate receipt of the top portions T of the respective containers through the respective container openings 541*a*, but may be positioned other than in engagement with the rolled rim edge of the respective containers.

In addition, the edge of the container retention portion 535*a* of the attachment panel 531*a* surrounding the container openings 541*a* can engage the rolled rim edge or other top structure of the containers.

In the course of movably engaging the attachment panel 531*a* with the containers CA1, CA2, CA3, CA4, the container retention portion 535*a* of the attachment panel 531*a* can flexibly reconfigure to accommodate the diameters of the top portions T of the containers. In this regard, the container retention portion 535*a* can separate from the relief tabs 589*a* at the oblique cuts 593*a* and can additionally flex/at least partially fold at the fold line 595*a* to facilitate additional flexible movement of the container retention portion 535*a* and/or to minimize shear stresses on the carrier 505.

The attachment panel 531*b* can engage the containers CB1, CB2, CB3, CB4 in a manner similar to that described above with regard to the engagement of the attachment panel 531*a* with the containers CA1, CA2, CA3, CA4.

The carrier 505/package 510 provides the same or similar advantages to those described above with respect to the carrier 105/package 110, the carrier 205/package 210, and the carrier 405/package 410, such as materials savings and waste reduction, in a construct that provides multiple points of adhesive attachment of the material of the blank 503/carrier 505 to the respective containers, e.g., at the central panels 125*a*, 125*b*, in addition to the support provided to the containers via engagement with the container retention features of the attachment panels 531*a*, 531*b*. Such a configuration also exposes portions of the containers on exterior portions of the carrier 505/package 510, e.g., the upper portions T of the respective containers through the container openings 541*a*, 541*b* for enhanced product visibility.

Figure 14:
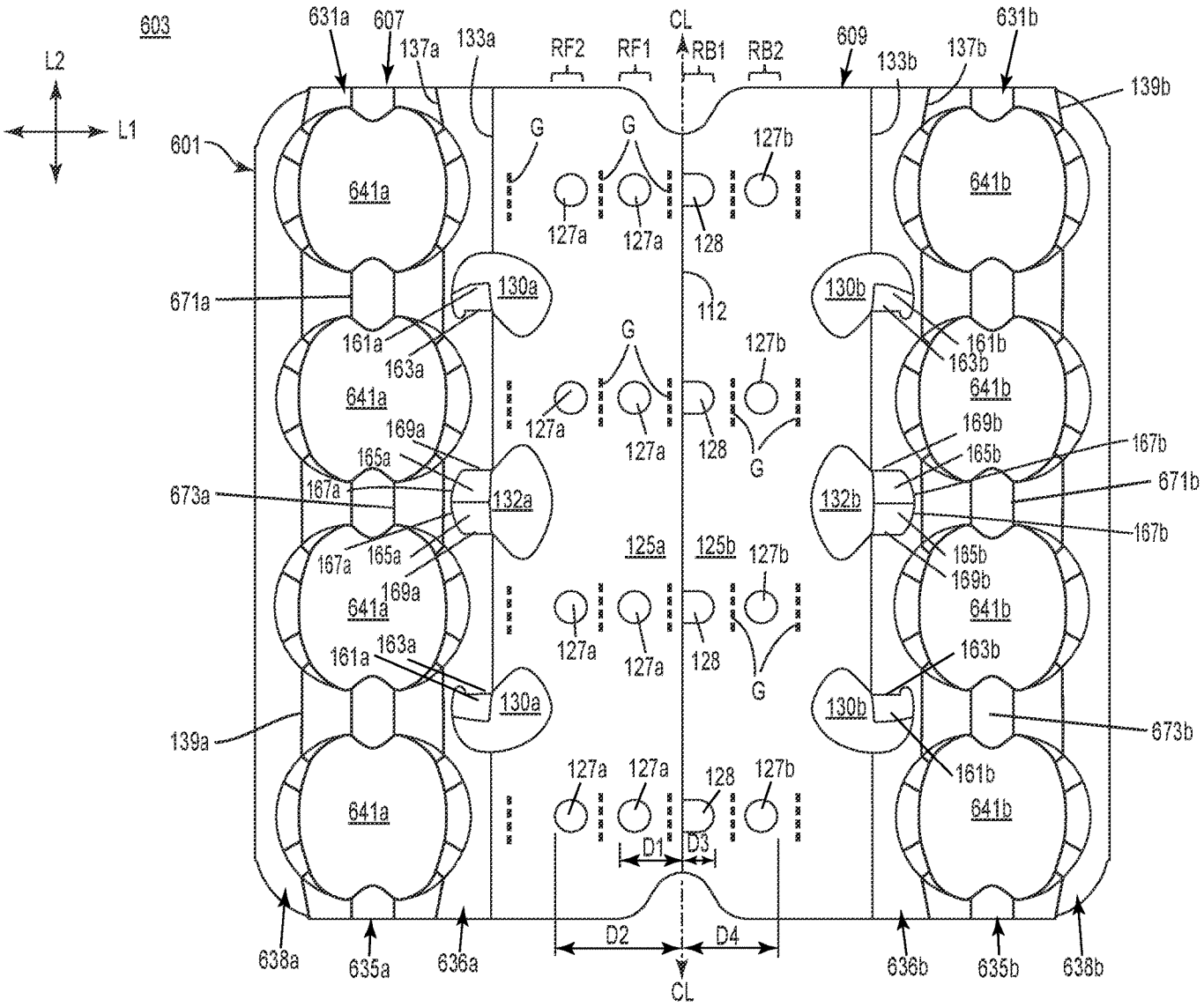
FIG. 14 is a schematic plan view of an outer surface of a blank for forming a carrier according to a fifth exemplary embodiment of the disclosure.
Figure 15:
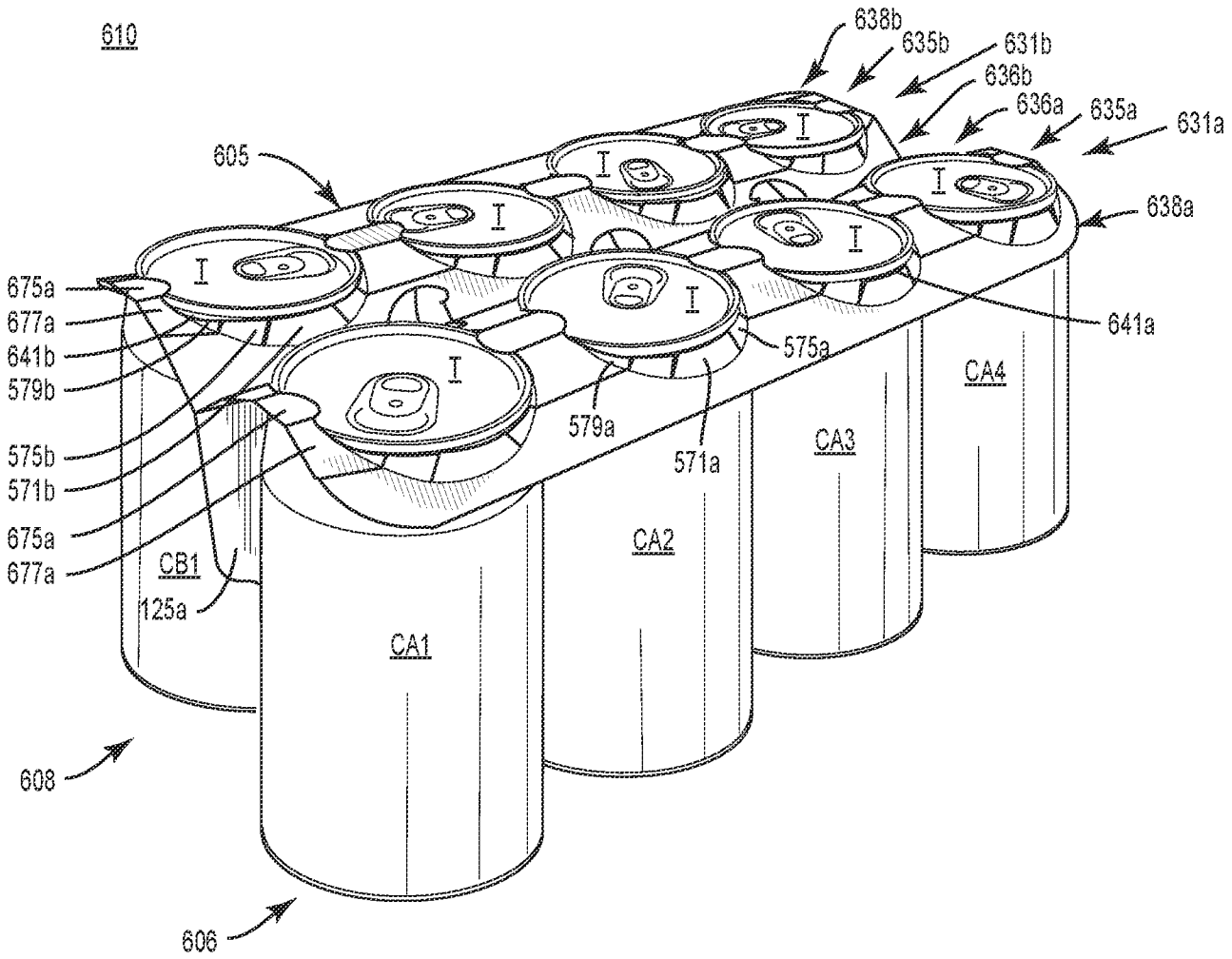
FIG. 15 is a perspective view of a package and carrier formed from the blank of FIG. 14 according to the fifth exemplary embodiment.

FIG. 14 is a plan view of the exterior side 601 of a blank, generally indicated at 603, used to form a carrier 605 (FIG. 15) for containing one or more containers according to a fifth exemplary embodiment of the disclosure. The blank 603 and the carrier 605 formed therefrom can have one or more features that are substantially similar to the blanks 103, 203, 403, 503 and the carriers 105, 205, 405, and 505 described above, and like or similar components are referenced with like or similar reference numbers. The carrier 605 formed from the blank 603 can be provided with one or more containers as a package 610 (FIG. 15).

As shown, the blank 603 includes a front portion 607 for forming a front portion 606 of the carrier 605 and a back portion 609 for forming a back portion 608 of the carrier 605. The front portion 607 of the blank 603 includes a front attachment panel 631*a* having a container retention portion 635*a*, an interior marginal portion 636*a* formed between the lateral fold line 137*a* and the fold line 133*a*, and an exterior marginal portion 638*a* formed between the lateral fold line 139*a* and a free edge of the attachment panel 631*a*. As shown, lateral end portions of the fold lines 137*a*, 139*a* can have oblique end portions, e.g., that are arranged on a convergent path toward one another.

Figure 14B:
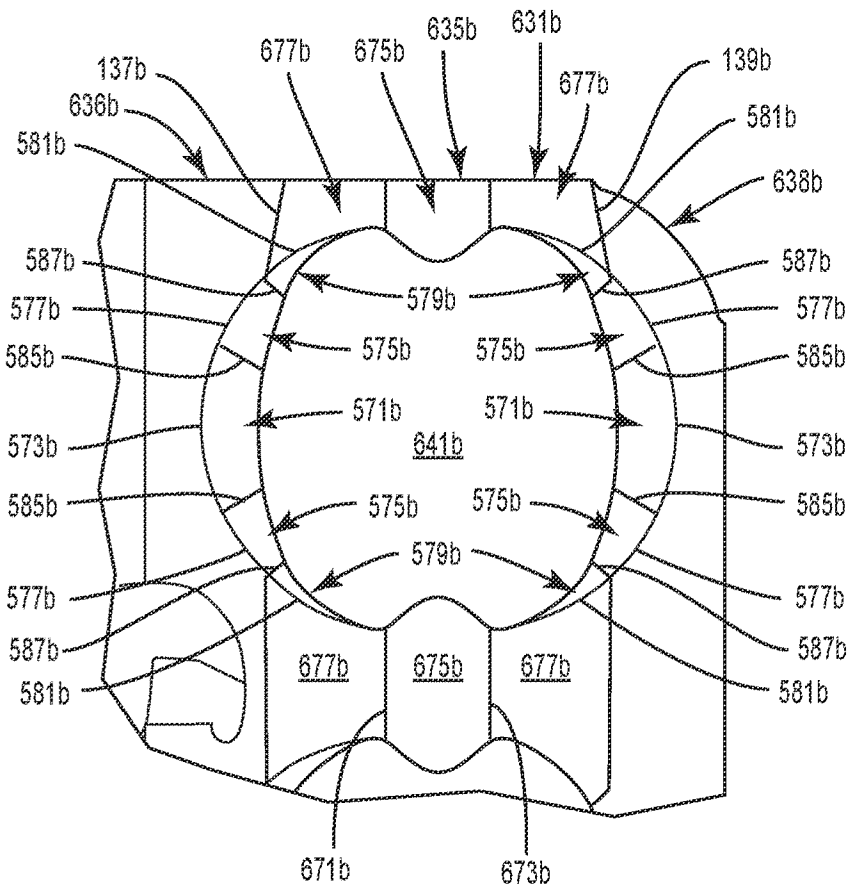
FIG. 14B is an enlarged view of another portion of the blank of FIG. 14.
Figure 14A:
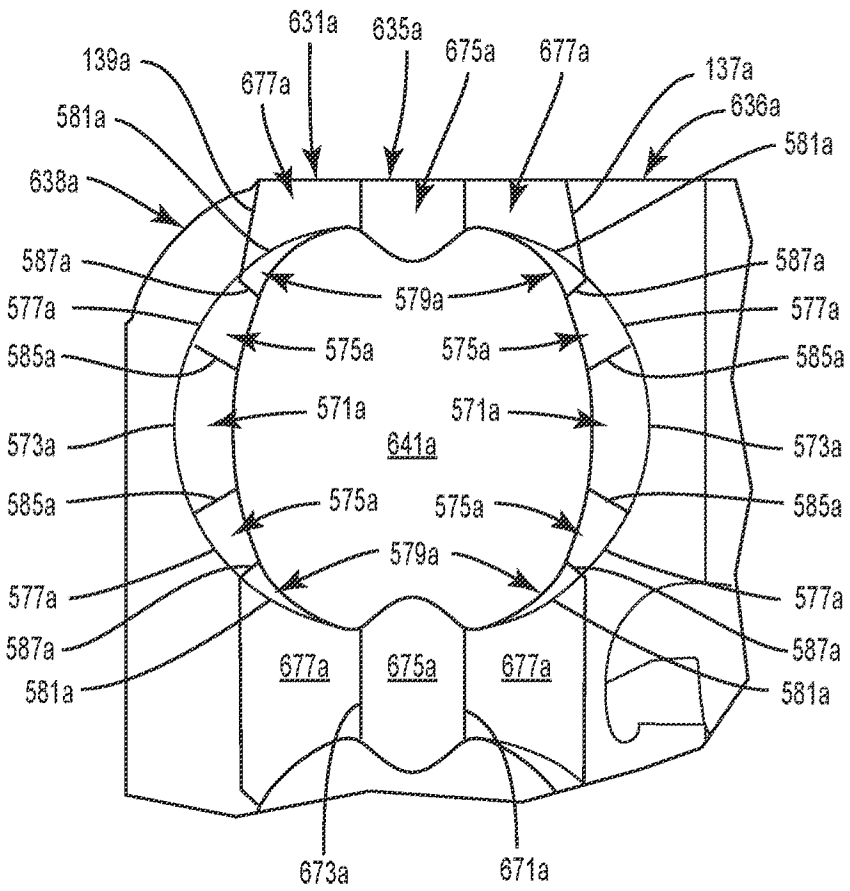
FIG. 14A is an enlarged view of a portion of the blank of FIG. 14.

With additional reference to FIG. 14A, the container retention features of the attachment panel 631*a* include laterally spaced container openings 641*a* that have a generally circular profile. As also shown, the container retention tabs 571*a*, 575*a*, 579*a* are arranged to extend into longitudinally opposed portions of the container openings 641*a*.

In the illustrated embodiment, a pair of spaced lateral fold lines 671*a*, 673*a* are arranged between the fold lines 137*a*, 139*a* and are interrupted by central portions of the respective container openings 641*a*. In this regard, the fold lines 671*a*, 673*a* define respective tab portions 675*a* of the container retention portion 635*a* of the attachment panel 631*a* laterally adjacent each respective container opening 641*a*, and which extend into respective portions of the respective container openings 641*a*. Respective oblique portions 677*a* are foldably connected to the respective tab portions 675*a* of the container retention portion 635*a* at respective portions of the fold lines 137*a*, 139*a*, and are defined between the respective fold lines 671*a*, 137*a* and respective fold lines 673*a*, 139*a*.

The back portion 609 of the blank 603 includes a back central panel 125*b* and a back container retention panel or back attachment panel 631*b* having associated features that are generally a mirror-image of the corresponding panels and flaps of the front portion 607 of the blank 603. Corresponding components (e.g., panels, flaps, fold lines, cuts, etc.) have been designated by corresponding reference numbers that differ by the "a" or "b" suffix, with the "a" components corresponding to the front portion 607 of the blank 603 and the "b" components corresponding to the back portion 609 of the blank 603. The features of the attachment panel 631*b* are best shown in FIG. 14B.

Referring additionally to FIG. 15, the carrier 605 and a package 610 that includes the carrier 605 and the containers CA1, CA2, CA3, CA4, CB1, CB2, CB3, CB4 can be formed in a similar manner as that described above with respect to the carrier 105/package 110, the carrier 205/package 210, the carrier 405/package 410, and the carrier 505/package 510.

With regard to the container retention features of the carrier 605, the upper or top portions T of the respective containers CA1, CA2, CA3, CA4 can be at least partially received through the respective container retention openings 641*a*. During such movement, the container retention tabs 571*a*, 575*a*, 579*a* can contact the top portions T of respective containers so as to be urged to fold at least partially upwardly at the respective fold lines 573*a*, 577*a*, 581*a* so as to be positioned to engage, for example, a rolled rim edge or other top structure of the respective container CA1, CA2, CA3, CA4.

Furthermore, as the attachment panel 631*a* is lowered over the containers CA1, CA2, CA3, CA4, the tab portions 675*a* of the container retention portion 635*a* can be positioned to overlie/engage the respective top portions T of the containers CA1, CA2, CA3, CA4 received in the respective container openings 641*a*. The oblique portions 677*a* of the container retention portion 635*a* can also be urged to fold at least partially downwardly at portions of the respective fold lines 671*a*, 673*a* toward an oblique arrangement with the respective tab portions 675*a*.

The attachment panel 631*b* can engage the containers CB1, CB2, CB3, CB4 in a similar manner as described above with regard to the engagement of the attachment panel 631*a* with the containers CA1, CA2, CA3, CA4.

The carrier 605/package 610 provides the same or similar advantages to those described above with respect to the carrier 105/package 110, the carrier 205/package 210, the carrier 405/package 410, and the carrier 505/package 510, such as materials savings and waste reduction, in a construct that provides multiple points of adhesive attachment of the material of the blank 603/carrier 605 to the respective containers, e.g., at the central panels 125*a*, 125*b*, in addition to the support provided to the containers via engagement with the container retention features of the attachment panels 631*a*, 631*b*. Such a configuration also exposes portions of the containers on exterior portions of the carrier 605/package 610, e.g., the upper portions T of the respective containers through the container openings 641*a*, 641*b* for enhanced product visibility.

Figure 16:
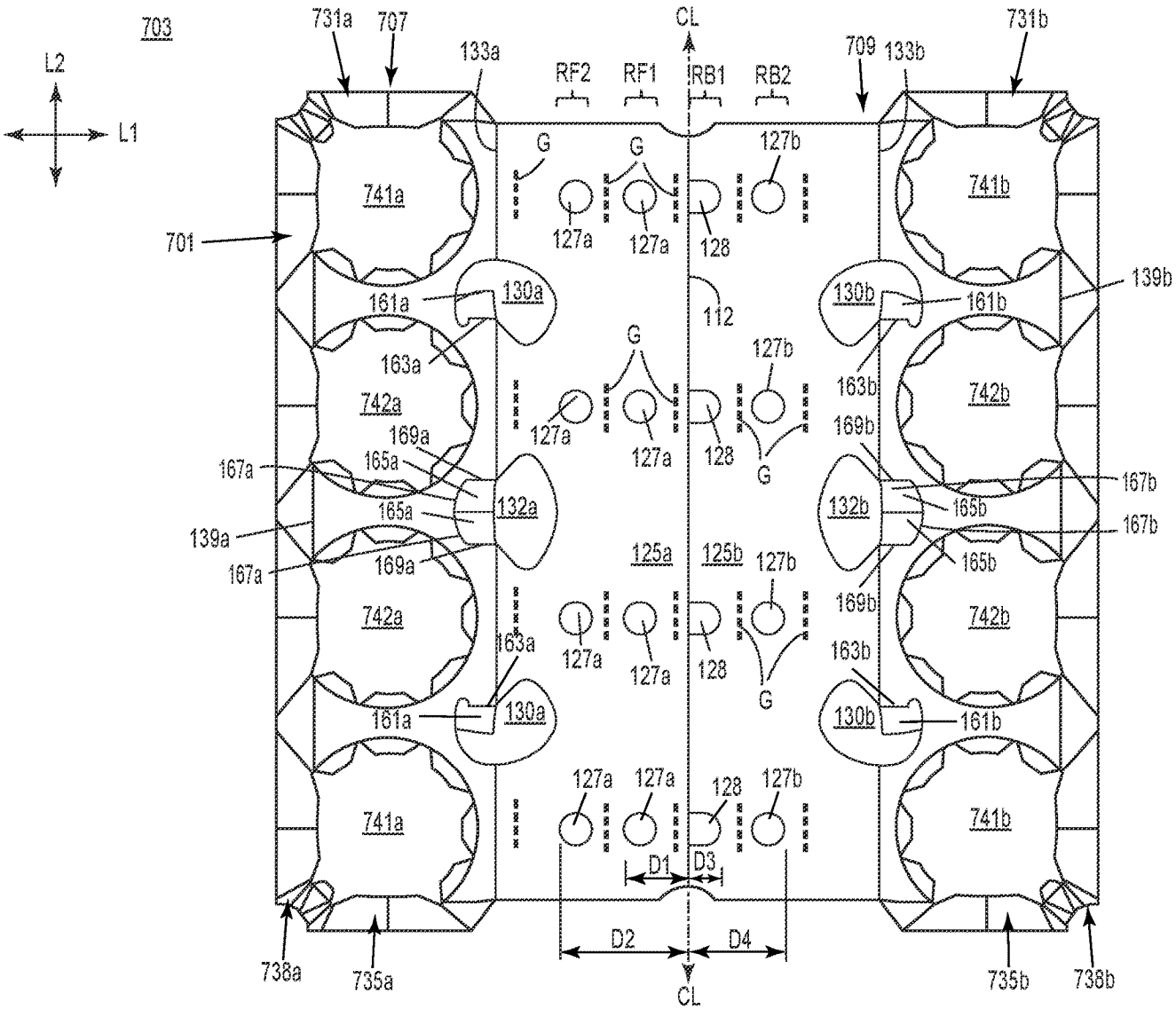
FIG. 16 is a schematic plan view of an outer surface of a blank for forming a carrier according to a sixth exemplary embodiment of the disclosure.
Figure 17:
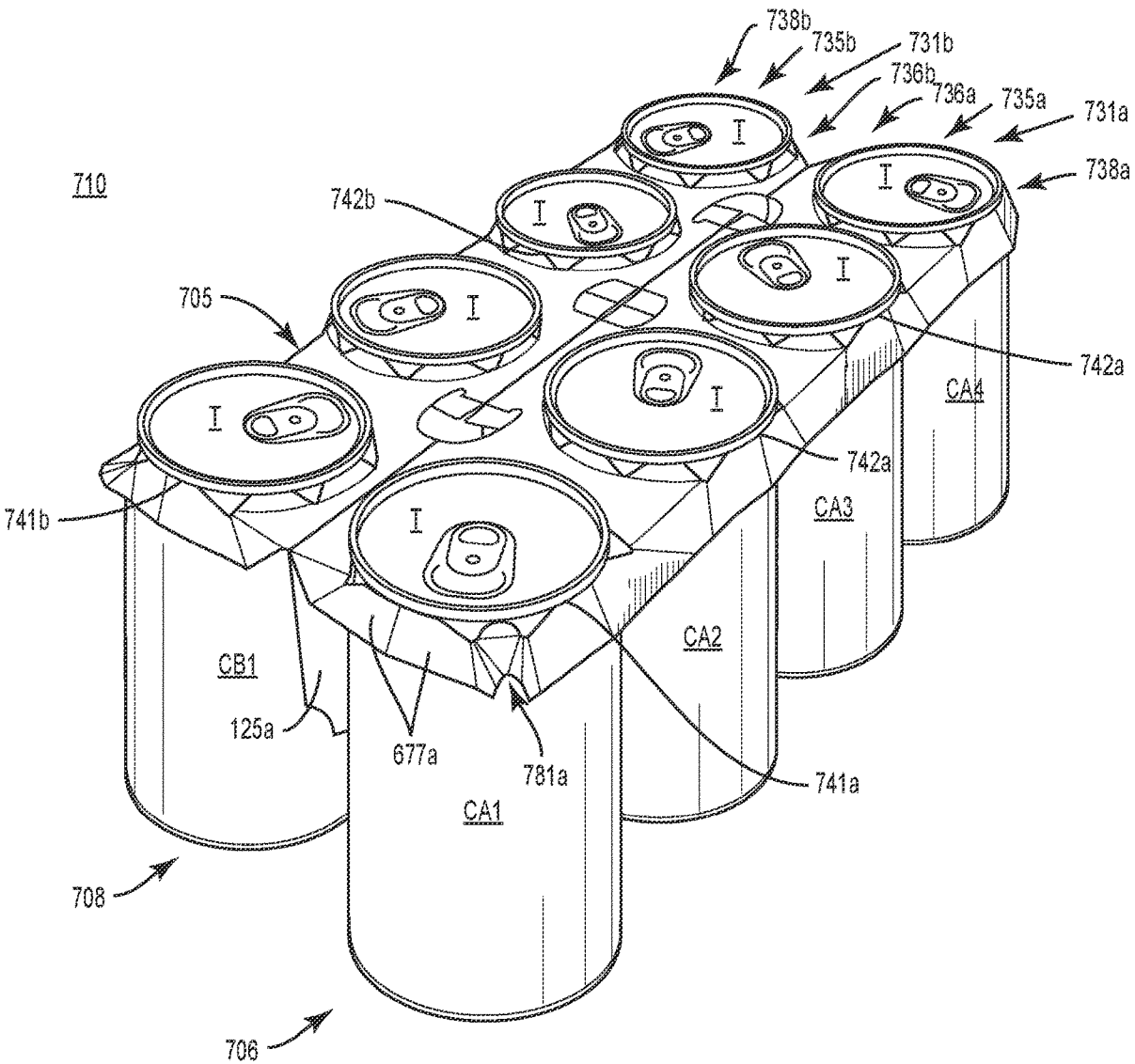
FIG. 17 is a perspective view of a package and carrier formed from the blank of FIG. 16 according to the sixth exemplary embodiment.

FIG. 16 is a plan view of the exterior side 701 of a blank, generally indicated at 703, used to form a carrier 705 (FIG. 17) for containing one or more containers according to a sixth exemplary embodiment of the disclosure. The blank 703 and the carrier 705 formed therefrom can have one or more features that are substantially similar to the blanks 103, 203, 403, 503, 603 and the carriers 105, 205, 405, 505, 605 described above, and like or similar components are referenced with like or similar reference numbers. The carrier 705 formed from the blank 703 can be provided with one or more containers as a package 710 (FIG. 17).

As shown, the blank 703 includes a front portion 707 for forming a front portion 706 of the carrier 705 and a back portion 709 for forming a back portion 708 of the carrier 705. The front portion 707 of the blank includes a front attachment panel 731*a* having a container retention portion 735*a*. As shown, the container retention portion 735*a* of the front attachment panel 731*a* is devoid of the fold line 137*a*, but the fold line 137*a* can be present without departing from the disclosure.

Figure 16B:
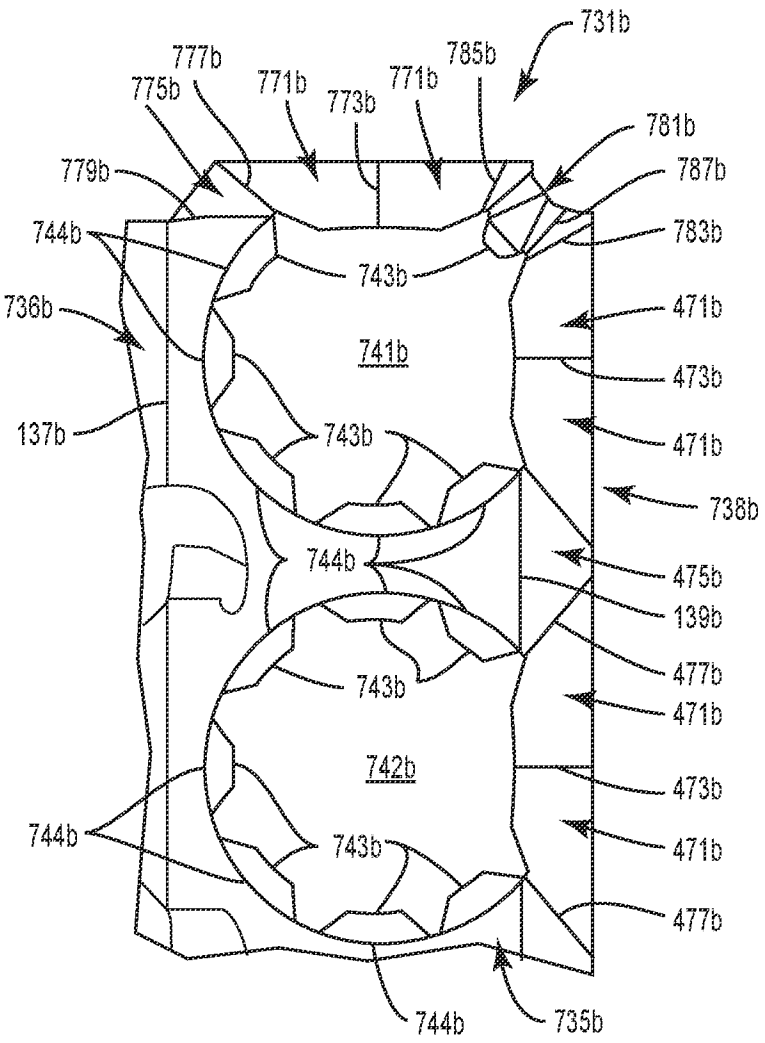
FIG. 16B is an enlarged view of another portion of the blank of FIG. 16.
Figure 16A:
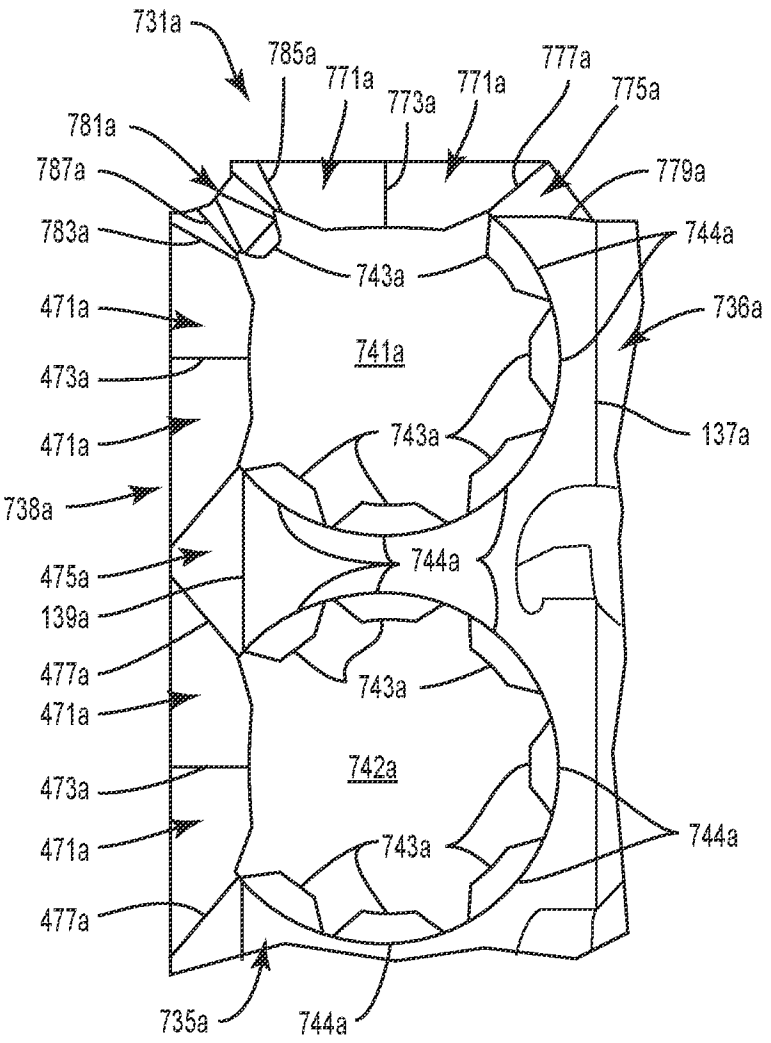
FIG. 16A is an enlarged view of a portion of the blank of FIG. 16.

With additional reference to FIG. 16A, the front attachment panel 731*a* can include container retention features that include at least laterally outer container openings 741*a* proximate the longitudinal edges of the blank 703, and laterally inner container openings 742*a* positioned between the laterally outer container openings 741*a*. While the laterally outer container openings 741*a* are shown having a slightly different configuration than the laterally inner container openings 742*a*, it will be understood that the container openings 741*a*, 742*a* can have similar configurations without departing from the disclosure.

The laterally outer container openings 741*a*, as shown, have a generally circular profile, but can include one or more straight/angled/chamfered edges. A plurality of container retention tabs is foldably connected to the attachment panel 731*a* and extend into the container opening 741*a*, and can include retention tabs 743*a* at least partially foldably connected to the attachment panel 731*a* at respective lines of weakening or fold lines 744*a*. In one embodiment, the retention tabs 743*a* can have the substantially same configuration, or one or more of the retention tabs 743*a* could have a different configuration without departing from the disclosure.

As also shown in FIG. 16A, the laterally inner container openings 742*a* can have a configuration that is generally similar to the laterally outer container openings 741*a*. In the illustrated embodiment, the laterally inner container openings 742*a* can be devoid of a straight/angled/chamfered edge, and can include a different number and/or arrangement of container retention tabs 743*a*. It will be understood that the container retention openings 741*a*, 742*a* can have similar or different configurations to one another, or can have a different configuration than illustrated, without departing from the disclosure.

The container retention features of the blank 703 and the carrier 705 formed therefrom can also include respective plurality of container engagement flaps that are foldably connected to the lateral ends of the attachment panel 731*a*. As shown, each plurality of container engagement flaps includes a pair of major, e.g., relatively larger, container engagement flaps 771*a* foldably connected to one another at a lateral fold line 773*a*, and a minor, e.g., relatively smaller, container engagement flap 775*a* foldably connected to one of the container engagement flaps 771*a* at an oblique fold line 777*a* and to the attachment panel 731*a* at an oblique fold line 779*a*. As shown, the major container engagement flaps 771*a* can have laterally inner free edges that at least partially form an edge of the respective container openings 741*a*.

Still referring to FIGS. 16 and 16A, the exterior marginal portion 738*a* of the attachment panel 731*a* includes respective pairs of the container engagement portions 471*a* foldably connected to one another at a longitudinal fold line 473*a*. The laterally inner free edges of the container engagement portions 471*a* at least partially form an edge of the respective container openings 741*a*, 742*a*.

Each container engagement portion 471*a* is foldably connected to a respective connector portion 475*a* of the exterior marginal portion 738*a* of the attachment panel 731*a* at respective oblique fold lines 477*a*, and each connector portion 475*a* is foldably connected to a respective portion of the lateral fold line 139*a*.

As also shown, corner portions 781*a* of the attachment panel 731*a* can be foldably connected to the exterior marginal portion 738*a* of the attachment panel 731*a* at an oblique fold line 783*a* and to an adjacent container engagement flap 771*a* at an oblique fold line 785*a*. The corner portions 781*a* can include a plurality of fold lines 787*a* to facilitate flexible/foldable reconfiguration of the corner portions upon formation of the carrier 705 from the blank 703, as described further herein. In one embodiment, a container retention tab 743*a* can be foldably connected to the corner portion 781*a* at a respective fold line of the plurality of fold lines 787*a*.

The back portion 709 of the blank 703 includes a back central panel 125*b*, and a back container retention panel or back attachment panel 731*b* having associated features that are generally a mirror-image of the corresponding panels and flaps of the front portion 707 of the blank 703. Corresponding components (e.g., panels, flaps, fold lines, cuts, etc.) have been designated by corresponding reference numbers that differ by the "a" or "b" suffix, with the "a" components corresponding to the front portion 707 of the blank 703 and the "b" components corresponding to the back portion 709 of the blank 703. The features of the attachment panel 731*a* are best shown in FIG. 16B.

Referring additionally to FIG. 17, the carrier 705 and a package 710 that includes the carrier 705 and the containers CA1, CA2, CA3, CA4, CB1, CB2, CB3, CB4 can be formed in a similar manner as that described above with respect to the carrier 105/package 110, the carrier 205/package 210, the carrier 405/package 410, the carrier 505/package 510, and the carrier 605/package 610.

With regard to the container retention features of the carrier 705, the upper or top portions T of the respective containers CA1, CA2, CA3, CA4 can be at least partially received through the respective container openings 741*a*, 742*a* in the front attachment panel 731*a*. During such movement, the container retention tabs 743*a* can contact the top portions T of respective containers such that the container retention tabs 743*a* are urged to fold at least partially upwardly at the respective fold lines 744*a* so as to be positioned to engage, for example, a rolled rim edge or other top structure of the respective container CA1, CA2, CA3, CA4.

In addition, the container engagement flap 775*a* can fold downwardly relative to the attachment panel 731*a* at the respective fold lines 779*a* to position the container engagement flaps 771*a* to fold relative to each other at the fold line 773*a* and to fold relative to the container engagement flap 775*a* at the fold line 777*a*. In the illustrated arrangement, the container engagement flaps 771*a* are obliquely arranged relative to one another and obliquely downwardly arranged relative to the attachment panel 731*a* such that the laterally inner free edges of the container engagement flaps 771*a* are positioned to contact or engage a rolled rim or other top structure of the respective containers CA1, CA4.

Furthermore, during the above-described engagement of the attachment panel 731*a* with the containers CA1, CA2, CA3, CA4, the corner portion 781*a* can fold at the respective fold lines 783*a*, 785*a* toward an oblique arrangement relative to the exterior marginal portion 738*a* and the container retention portion 735*a* of the attachment panel 731*a*, and the container engagement flap 771*a*. In the course of such movement of the corner portion 781*a*, the corner portion 781*a* can at least partially reconfigure via the plurality of fold lines 787*a* to conform, e.g., contour, toward a generally curved or oblique arrangement between the exterior marginal portion 738*a* and the adjacent container engagement flap 771*a*.

Furthermore, the container engagement portions 787*a* of the exterior marginal portion 738*a* are obliquely arranged relative to one another and obliquely downwardly arranged relative to the remainder of the attachment panel 731*a* such that the laterally inner free edges of the container engagement portions 781*a* are positioned to contact or engage a rolled rim or other top structure of the respective containers CA1, CA2, CA3, CA4.

The attachment panel 731*b* can engage the containers CB1, CB2, CB3, CB4 in a manner similar to that described above with regard to the engagement of the attachment panel 731*a* with the containers CA1, CA2, CA3, CA4.

The carrier 705/package 710 provides the same or similar advantages to those described above with respect to the carrier 105/package 110, the carrier 205/package 210, the carrier 405/package 410, the carrier 505/package 510, and the carrier 605/package 610, such as materials savings and waste reduction in a construct that provides multiple points of adhesive attachment of the material of the blank 703/carrier 705 to the respective containers, e.g., at the central panels 125*a*, 125*b*, in addition to the support provided to the containers via engagement with the container retention features of the attachment panels 731*a*, 731*b*. Such a configuration also exposes portions of the containers on exterior portions of the carrier 705/package 710, e.g., the upper portions T of the respective containers through the container openings 741*a*, 741*b*, 742*a*, 742*b* for enhanced product visibility.

Figure 18:
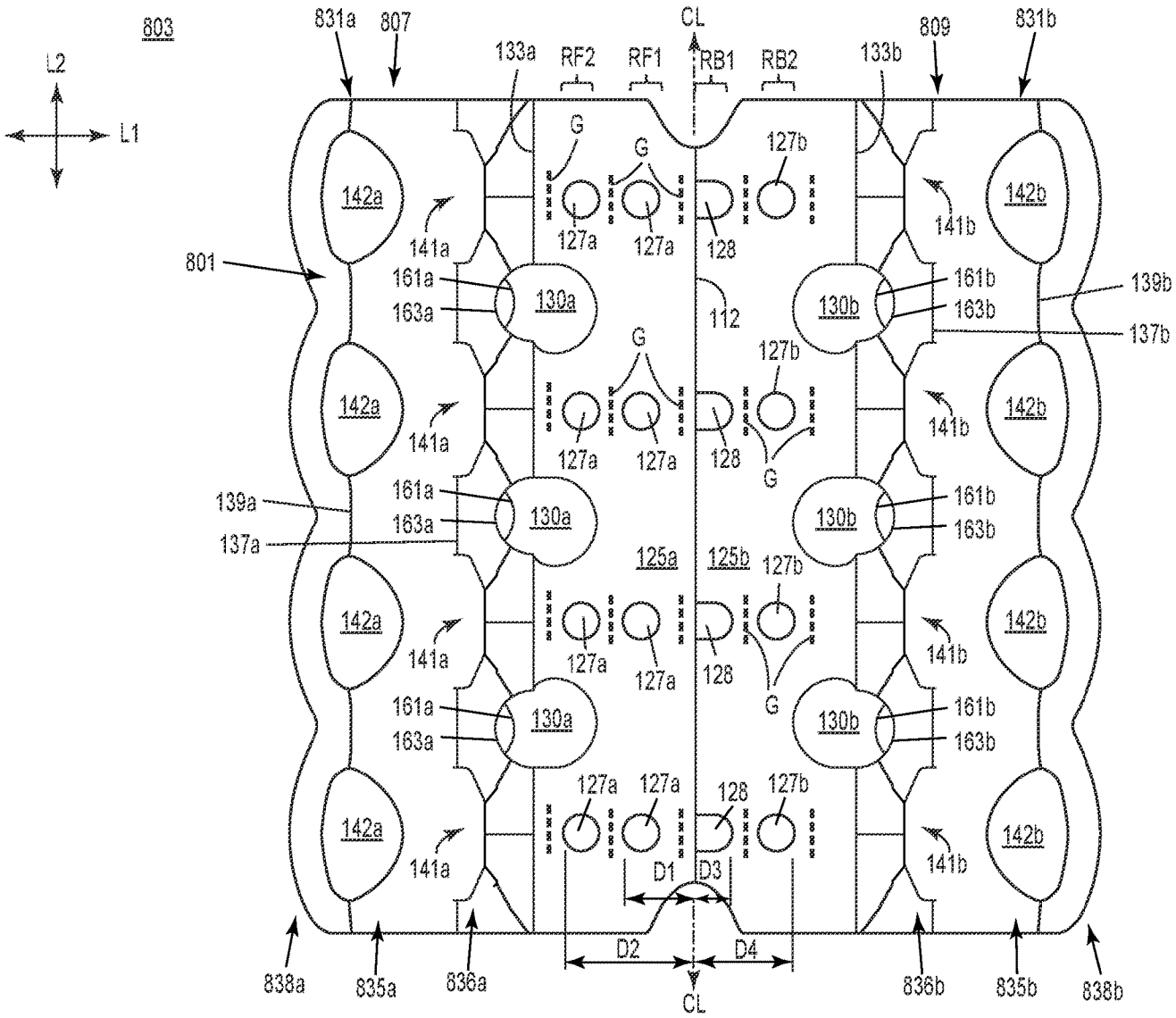
FIG. 18 is a schematic plan view of an outer surface of a blank for forming a carrier according to a seventh exemplary embodiment of the disclosure.
Figure 19:
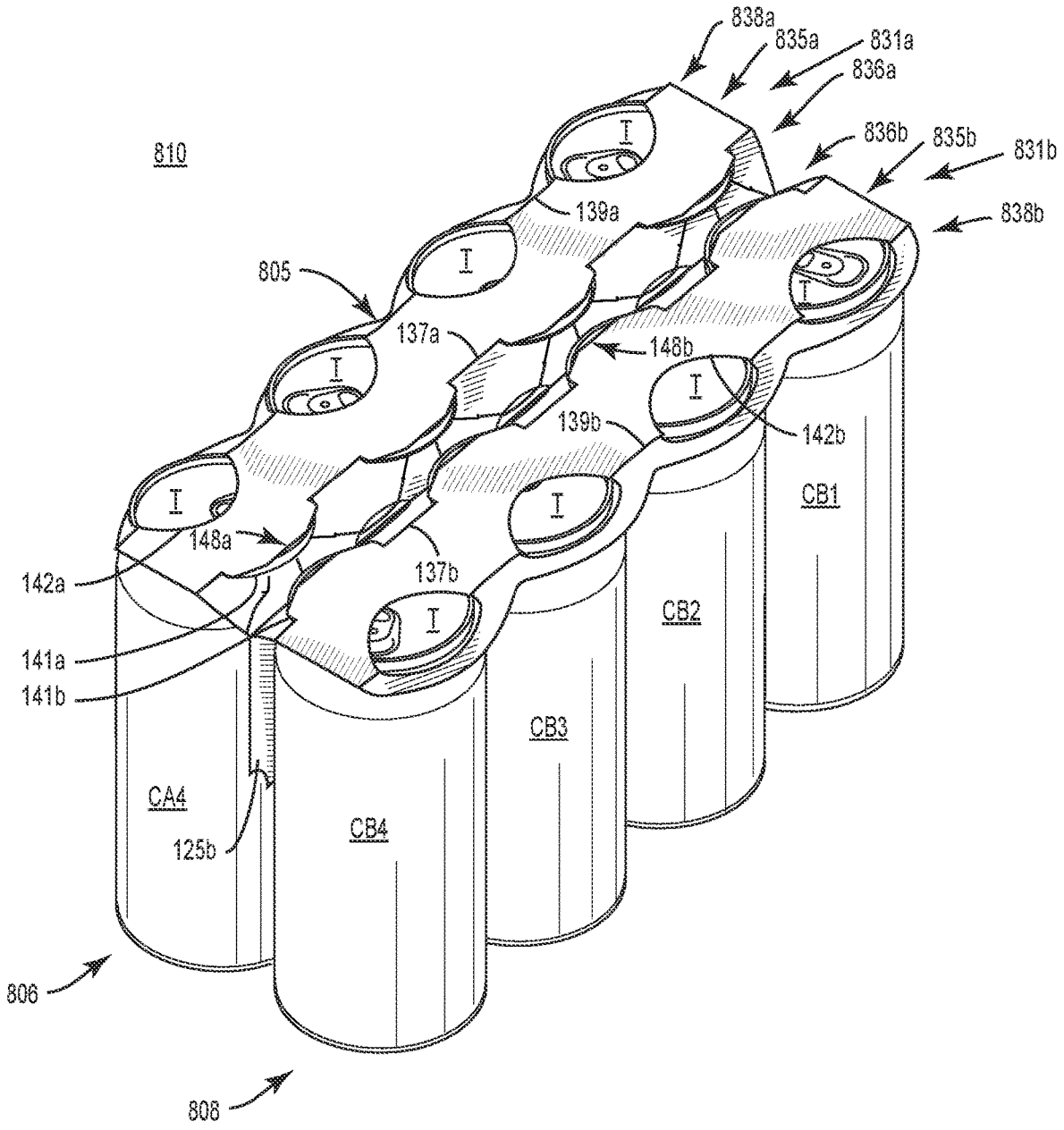
FIG. 19 is a perspective view of a package and carrier formed from the blank of FIG. 18 according to the seventh exemplary embodiment.

FIG. 18 is a plan view of the exterior side 801 of a blank, generally indicated at 803, used to form a carrier 805 (FIG. 19) for containing one or more containers according to a seventh exemplary embodiment of the disclosure. The blank 803 and the carrier 805 formed therefrom can have one or more features that are substantially similar to the blanks 103, 203, 403, 503, 603, 703 and the carriers 105, 205, 405, 505, 605, 705 described above, and like or similar components are referenced with like or similar reference numbers. The carrier 805 formed from the blank 803 can be provided with one or more containers as a package 810 (FIG. 19).

As shown, the blank 803 includes a front portion 807 for forming a front portion 806 of the carrier 805 and a back portion 809 for forming a back portion 808 of the carrier 805. The front portion 807 of the blank 803 includes a front attachment panel 831*a* having a container retention portion

835*a*, an interior marginal portion 836*a* formed between the fold line 137*a* and the fold line 133*a*, and the exterior marginal portion 838*a* formed between the fold line 139*a* and a lateral free edge of the attachment panel 131*a*.

Figure 18B:
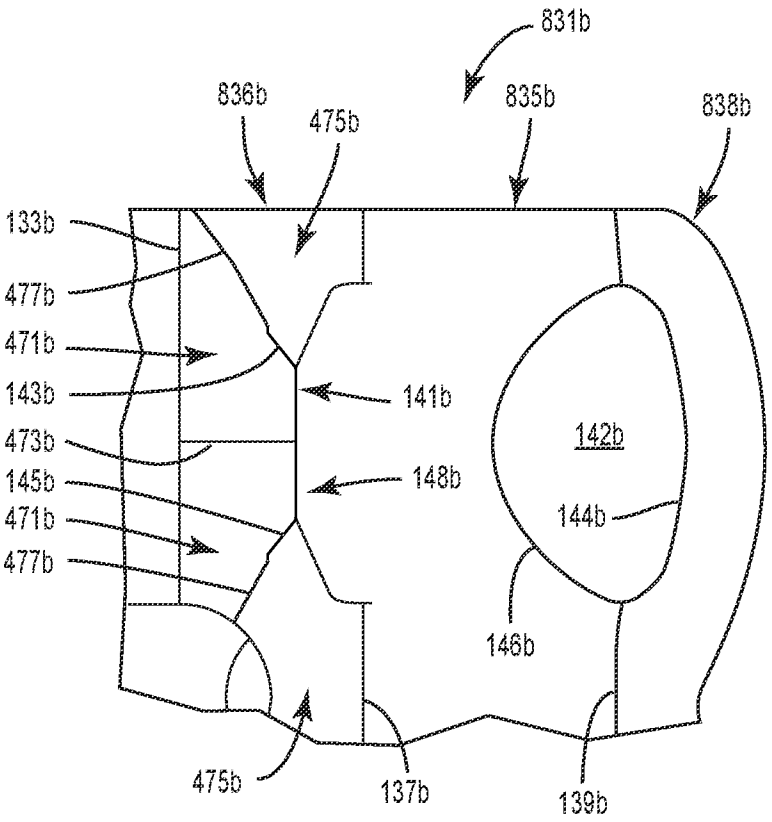
FIG. 18B is an enlarged view of another portion of the blank of FIG. 18.
Figure 18A:
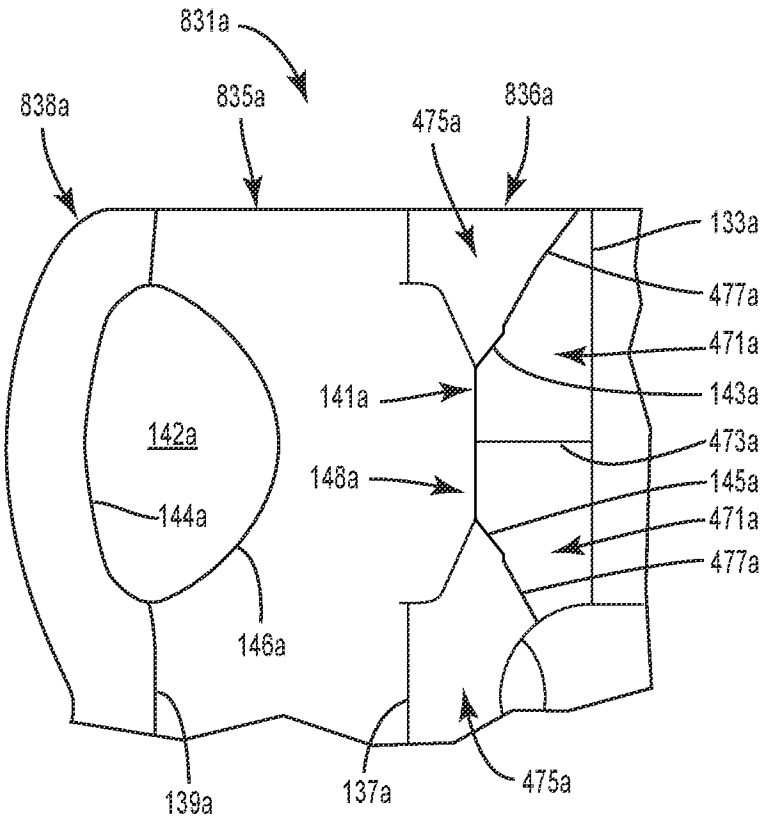
FIG. 18A is an enlarged view of a portion of the blank of FIG. 18.

With additional reference to FIG. 18A, the container retention features of the attachment panel 831*a* include the laterally spaced cuts 141*a* interrupting the fold line 137*a* and having the oblique cuts 143*a*, 145*a* extending therefrom. The attachment panel 831*a* also includes the laterally spaced container openings 142*a* interrupting the fold line 139*a* and positioned opposite the cuts 141*a*.

Still referring to FIGS. 18 and 18A, the interior marginal portion 836*a* of the attachment panel 831*a* includes respective pairs of the container engagement portions 471*a* foldably connected to one another at the respective longitudinal fold lines 473*a*.

Each container engagement portion 471*a* is foldably connected to the respective connector portion 475*a* of the interior marginal portion 836*a* of the attachment panel 831*a* at the respective oblique fold lines 477*a* which extend toward and intersect the respective oblique cuts 143*a*, 145*a*, and which also intersect the respective handle openings 130*a*. As shown, the laterally outermost oblique fold lines 477*a* may or may not extend fully to intersect the fold line 133*a*. In addition, each connector portion 475*a* is foldably connected to a respective portion of the lateral fold line 137*a*.

As also shown, handle features of the blank 803/carrier 805 can include the handle openings 130*a* and the handle reinforcement tabs 161*a* foldably connected to the marginal portion 836*a* of the attachment panel 831*a* at the respective fold lines 163*a* and extending into the respective handle openings 130*a*. The handle features of the blank 803/carrier 805 can have a different configuration without departing from the disclosure.

The back portion 809 of the blank 803 includes a back central panel 125*b* and a back container retention panel or back attachment panel 831*b* having associated features that are generally a mirror-image of the corresponding panels and flaps of the front portion 807 of the blank 803. Corresponding components (e.g., panels, flaps, fold lines, cuts, etc.) have been designated by corresponding reference numbers that differ by the "a" or "b" suffix, with the "a" components corresponding to the front portion 807 of the blank 803 and the "b" components corresponding to the back portion 809 of the blank 803. The features of the attachment panel 831*a* are best shown in FIG. 18B.

Referring additionally to FIG. 19, the carrier 805 and a package 810 that includes the carrier 805 and the containers CA1, CA2, CA3, CA4, CB1, CB2, CB3, CB4 can be formed in a similar manner as that described above with respect to the carrier 105/package 110, the carrier 205/package 210, the carrier 405/package 410, the carrier 505/package 510, the carrier 605/package 610, and the carrier 705/package 710.

For example, as the front attachment panel 831*a* is lowered or urged downwardly onto the containers CA1, CA2, CA3, CA4, the upper or top portions T of the respective containers CA1, CA2, CA3, CA4 can be at least partially received through the container openings 142*a* and respective openings formed by the respective cuts 141*a* in the front attachment panel 131*a*.

Such engagement of the containers CA1, CA2, CA3, CA4 and the attachment panel 831*a* can also cause the interior marginal portion 836*a* of the attachment panel 831*a* to fold at least partially downwardly at the fold line 137*a* to position the container engagement portions 471*a* to fold relative to each other at the respective fold lines 473*a* and to fold relative to the respective connector portions 475*a*, at the respective oblique fold lines 477*a*, and can further be folded at least partially downwardly at respective portions of the fold line 137*a*.

In the illustrated arrangement, the container engagement portions 477*a* of the interior marginal portion 836*a* are thus obliquely arranged relative to one another and obliquely downwardly arranged relative to the remainder of the attachment panel 831*a* such that free edges of the container engagement portions 471*a* formed upon separation from the respective cuts 141*a* are positioned to contact or engage a rolled rim or other top structure of the respective containers CA1, CA2, CA3, CA4.

Furthermore, the outer marginal portion 838*a* of the attachment panel 831*a* can fold downwardly at the fold lines 139*a* and having laterally inner free edges so as to form a generally continuous clip or band for facilitating engagement of the containers CA1, CA2, CA3, CA4, CB1, CB2, CB3, CB4 to the carrier 805 as described above with regard to the carrier 105.

The attachment panel 831*b* can engage the containers CB1, CB2, CB3, CB4 in a manner similar to that described above with regard to the engagement of the attachment panel 831*a* with the containers CA1, CA2, CA3, CA4.

The carrier 805/package 810 provides the same or similar advantages to those described above with respect to the carrier 105/package 110, the carrier 205/package 210, carrier 405/package 410, the carrier 505/package 510, the carrier 605/package 610, and the carrier 705/package 710, such as materials savings and waste reduction in a construct that provides multiple points of adhesive attachment of the material of the blank 803/carrier 805 to the respective containers, e.g., at the central panels 125*a*, 125*b*, in addition to the support provided to the containers via engagement with the container retention features of the attachment panels 831*a*, 831*b*. Such a configuration also exposes portions of the containers on exterior portions of the carrier 805/package 810, e.g., the upper portions T of the respective containers through the container openings 142*a*, 142*b* for enhanced product visibility.

Figure 20:
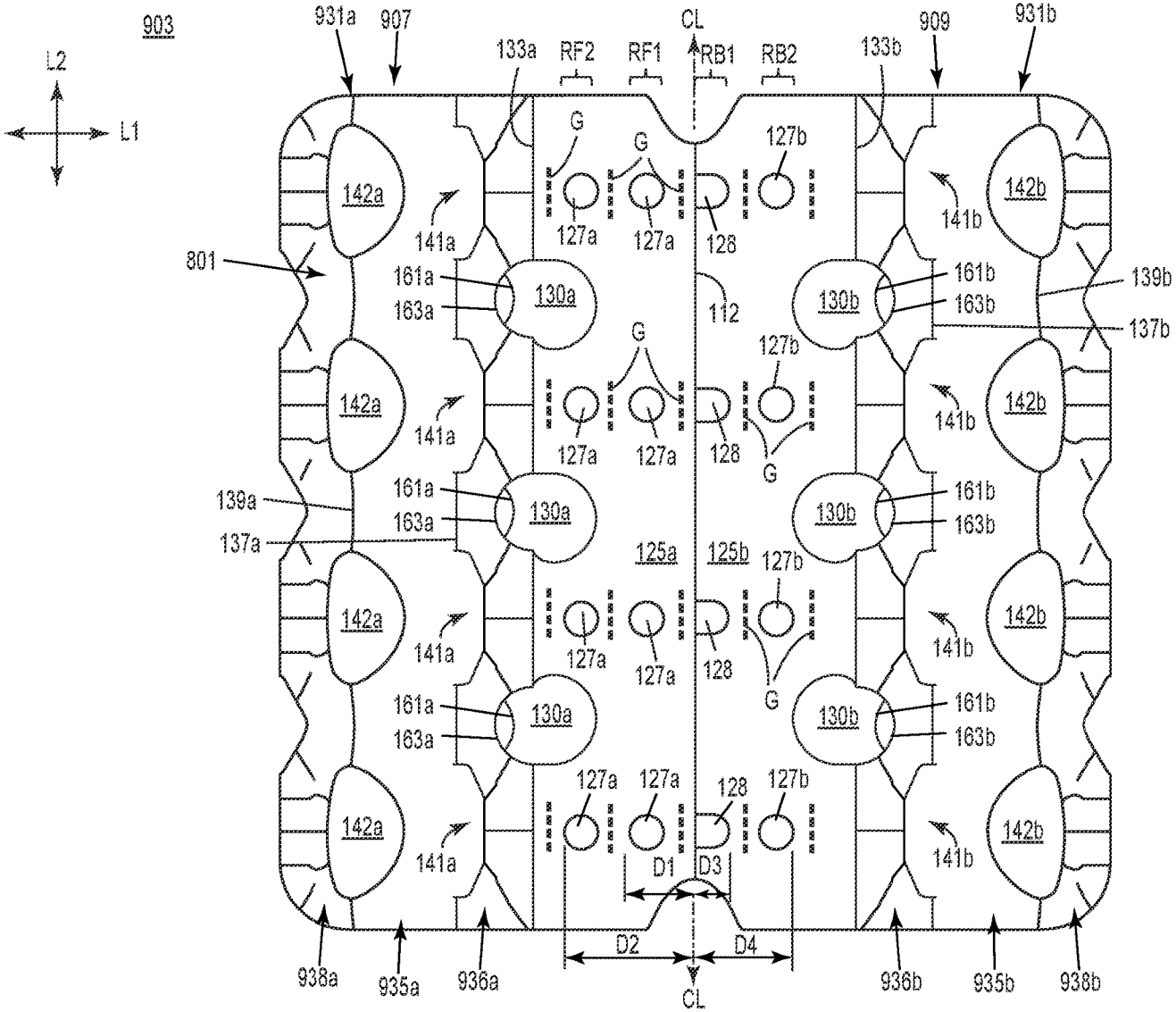
FIG. 20 is a schematic plan view of an outer surface of a blank for forming a carrier according to an eighth exemplary embodiment of the disclosure.
Figure 21:
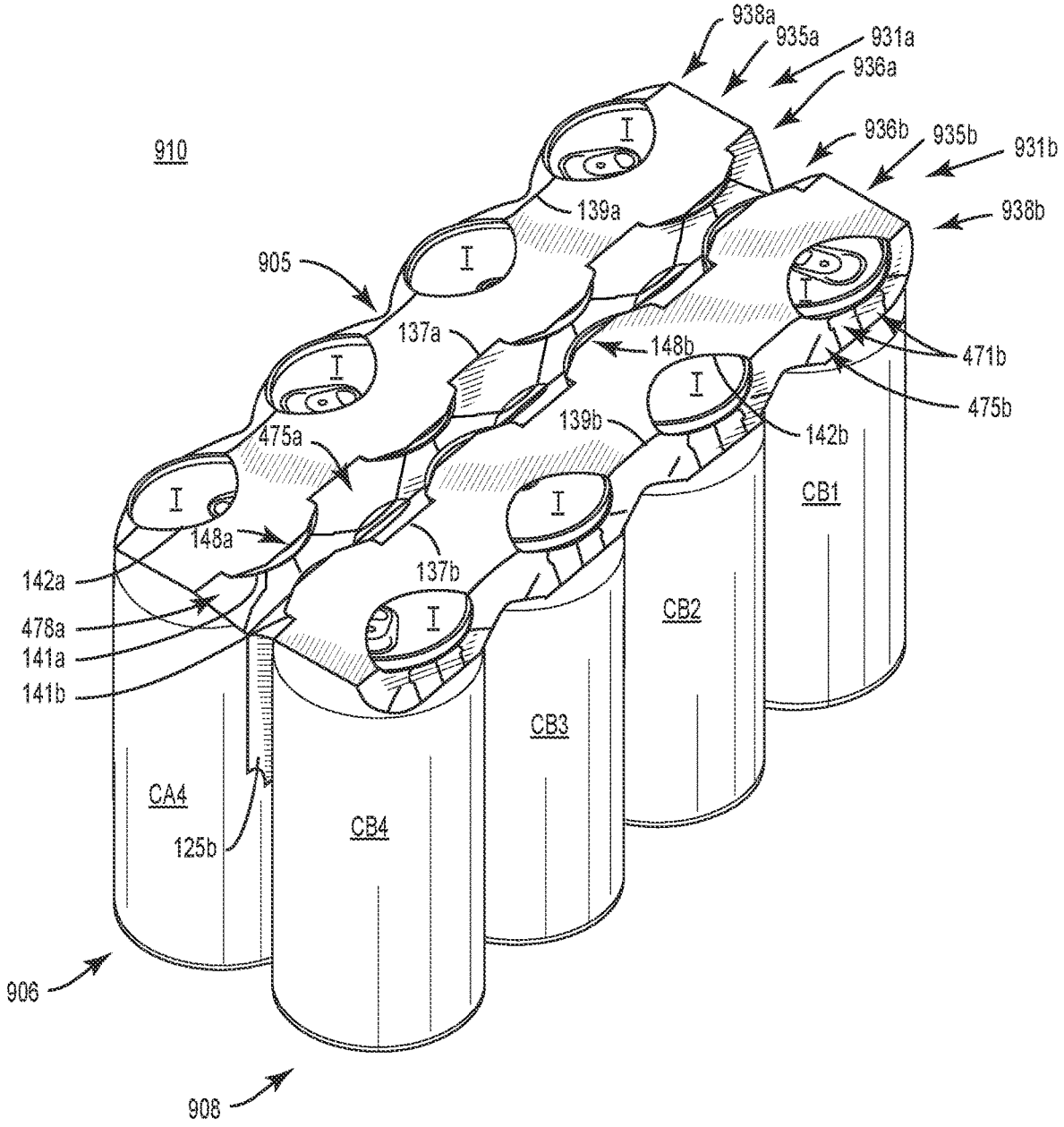
FIG. 21 is a perspective view of a package and carrier formed from the blank of FIG. 20 according to the eighth exemplary embodiment.

FIG. 20 is a plan view of the exterior side 901 of a blank, generally indicated at 903, used to form a carrier 905 (FIG. 21) for containing one or more containers according to an eighth exemplary embodiment of the disclosure. The blank 903 and the carrier 905 formed therefrom can have one or more substantially similar features to the blanks 103, 203, 403, 503, 603, 703, 803 and the carriers 105, 205, 405, 505, 605, 705, 805 described above, and like or similar components are referenced with like or similar reference numbers. The carrier 905 formed from the blank 903 can be provided with one or more containers as a package 910 (FIG. 21).

As shown, the blank 903 includes a front portion 907 for forming a front portion 906 of the carrier 905 and a back portion 909 for forming a back portion 908 of the carrier 905. The front portion 907 of the blank includes a front attachment panel 931*a* having the container retention portion 935*a*, an interior marginal portion 936*a* formed between the fold line 137*a* and the fold line 133*a*, and an exterior marginal portion 938*a* formed between the fold line 139*a* and a lateral free edge of the attachment panel 931*a*.

Figure 20B:
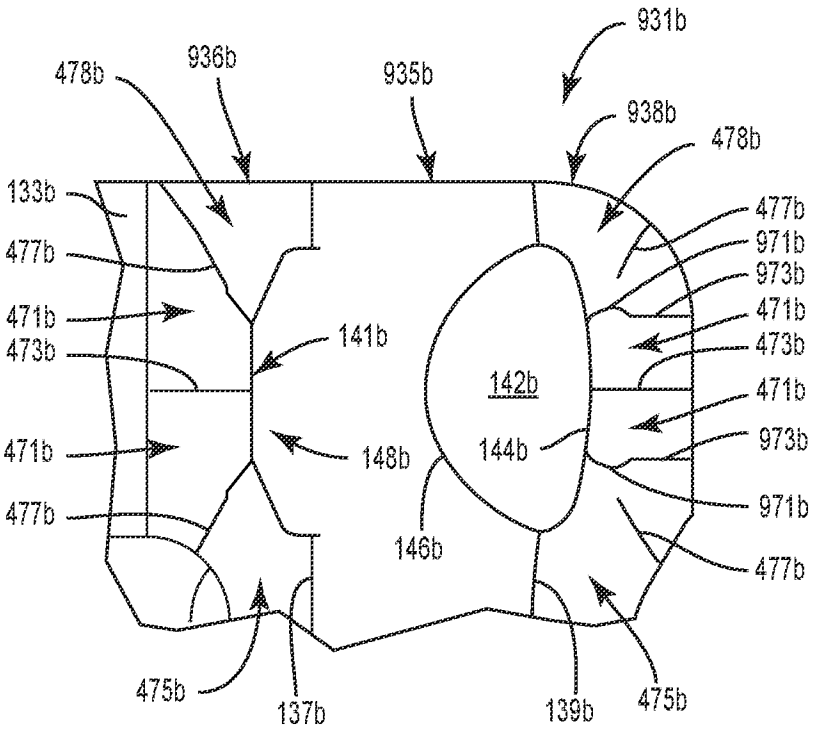
FIG. 20B is an enlarged view of another portion of the blank of FIG. 20.
Figure 20A:
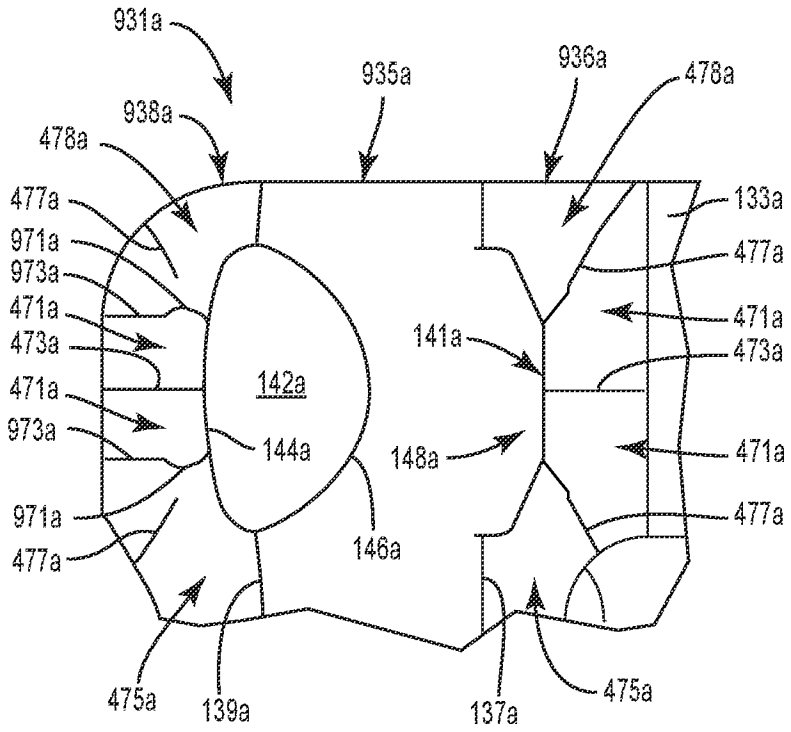
FIG. 20A is an enlarged view of a portion of the blank of FIG. 20.

With additional reference to FIG. 20A, the container retention portion 935*a* can be generally similar to the container retention portion 835*a* of the attachment panel 831*a* of the carrier 805 described above, the interior marginal portion 936*a* can be substantially similar to the interior marginal portion 836*a* of the attachment panel 831*a*, and the exterior marginal portion 938*a* can include the container engagement portions 471*a* and connector portions 475*a*, 478*a*. In addition, a pair of generally curved cuts 971*a* extend from the laterally outer edge of the container openings 142*a*, and respective fold lines 973*a* extend from the endpoints of the respective cuts 971*a* to the lateral free edge of the attachment panel 931*a*.

The blank 903/carrier 905 can also have handle features similar to those of the blank 803/carrier 905 described above. It will be understood that the blank 903/carrier 905 can have different handle features without departing from the disclosure.

The back portion 909 of the blank 903 includes a back central panel 125*b* and a back container retention panel or back attachment panel 931*b* having associated features that are generally a mirror-image of the corresponding panels and flaps of the front portion 907 of the blank 903. Corresponding components (e.g., panels, flaps, fold lines, cuts, etc.) have been designated by corresponding reference numbers that differ by the "a" or "b" suffix, with the "a" components corresponding to the front portion 907 of the blank 903 and the "b" components corresponding to the back portion 909 of the blank 903. The features of the attachment panel 931*b* are best shown in FIG. 20B.

Referring additionally to FIG. 21, the carrier 905 and a package 910 that includes the carrier 905 and the containers CA1, CA2, CA3, CA4, CB1, CB2, CB3, CB4 can be formed in a similar manner as that described above with respect to the carrier 105/package 110, the carrier 205/package 210, the carrier 405/package 410, the carrier 505/package 510, the carrier 605/package 610, the carrier 705/package 710, and the carrier 805/package 810.

For example, as the front attachment panel 931*a* is lowered or urged downwardly onto the containers CA1, CA2, CA3, CA4, the upper or top portions T of the respective containers CA1, CA2, CA3, CA4 can be at least partially received through respective openings formed by the respective cuts 141*a* in the front attachment panel 131*a* as well as through the container openings 142*a*.

Such engagement of the containers CA1, CA2, CA3, CA4 and the attachment panel 831*a* can also cause the marginal portions 936*a*, 938*a* of the attachment panel 931*a* to fold at least partially downwardly at the respective fold lines 137*a*, 139*a* to position the container engagement portions 471*a* to fold relative to each other at the respective fold lines 473*a* and to fold relative to the respective connector portions 475*a* at the respective oblique fold lines 477*a*, and can further be folded at least partially downwardly at respective portions of the respective fold lines 137*a*, 139*a*.

In the illustrated arrangement, the respective container engagement portions 471*a* of the marginal portions 936*a*, 938*a* are obliquely arranged relative to one another and obliquely downwardly arranged relative to the remainder of the attachment panel 931*a* such that free edges of the container engagement portions 471*a* are positioned to contact or engage a rolled rim or other top structure of the respective containers CA1, CA2, CA3, CA4. The cuts 971*a* and fold lines 973*a* in the container engagement portions 471*a* of the exterior marginal portion 938*a* can permit additional flexibility and reconfigurable engagement with the rims of the respective containers CA1, CA3, CA3, CA4.

Furthermore, the outer marginal portions 938*a* of the attachment panel 931*a* have laterally inner free edges that form a generally continuous clip or band for facilitating engagement of the containers CA1, CA2, CA3, CA4, as described above.

The attachment panel 931*b* of the back portion 908 of the carrier 905 can engage the containers CB1, CB2, CB3, CB4 in a manner similar to that described above with regard to the engagement of the attachment panel 931*a* with the containers CA1, CA2, CA3, CA4.

The carrier 905/package 910 provides the same or similar advantages to those described above with respect to the carrier 105/package 110, the carrier 205/package 210, the carrier 405/package 410, the carrier 505/package 510, the carrier 605/package 610, the carrier 705/package 710, and the carrier 805/package 810 such as materials savings and waste reduction in a construct that provides multiple points of adhesive attachment of the material of the blank 903/carrier 905 to the respective containers, e.g., at the central panels 125*a*, 125*b*, in addition to the support provided to the containers via engagement with the container retention features of the attachment panels 931*a*, 931*b*. Such a configuration also exposes portions of the containers on exterior portions of the carrier 905/package 910, e.g., the upper portions T of the respective containers through the container openings 142*a*, 142*b* for enhanced product visibility.

It will be understood that the blanks, carriers, and packages described herein can be provided in different configurations without departing from the disclosure. For example, one or more of the container openings 142*a*, 142*b*, 442*a*, 442*b*, 541*a*, 541*b*, 641*a*, 641*b*, 741*a*, 741*b*, 742*a*, 742*b* described can have a different size or arrangement, e.g., a smaller size so as to have the form of a slit or a cut, or could be omitted without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a plurality of panels comprising at least one central panel and at least one attachment panel foldably connected to the at least one central panel, the at least one attachment panel comprising container retention features for engaging at least one container of the plurality of containers, the at least one central panel comprises a plurality of openings and is for being positioned between and attached to adjacent containers of the plurality of containers, the plurality of openings comprises a first row of openings and a second row of openings spaced apart from the first row of openings, the first row of openings is spaced a first distance from a bottom edge of the at least one central panel, and the second row of openings is spaced a second distance from the bottom edge of the at least one central panel, the second distance is greater than the first distance.

2. The carrier of claim 1, wherein the container retention features comprise at least one curved cut in the at least one attachment panel for engaging a portion of at least one container of the plurality of containers.

3. The carrier of claim 2, wherein the at least one attachment panel comprises a container retention portion, an interior marginal portion foldably connected to the container retention portion at a first fold line, and an exterior marginal portion foldably connected to the container retention portion at a second fold line.

4. The carrier of claim 3, wherein the exterior marginal portion forms a continuous band for engaging at least one container of the plurality of containers.

5. The carrier of claim 3, wherein the at least one curved cut interrupts at least one of the first fold line and the second fold line.

6. The carrier of claim 3, wherein the at least one curved cut interrupts one of the first fold line and the second fold line, the container retention features further comprise at least one container opening, and the at least one container opening interrupts the other of the first fold line and the second fold line.

7. The carrier of claim 3, wherein at least one of the inner marginal portion and the outer marginal portion comprises a plurality of container engagement portions, each container engagement portion foldably connected to an adjacent container engagement portion.

8. The carrier of claim 1, wherein the container retention features comprise at least one container opening in the at least one attachment panel for at least partially receiving at least one container of the plurality of containers.

9. The carrier of claim 8, wherein the at least one attachment panel comprises a container retention portion, an interior marginal portion foldably connected to the container retention portion at a first fold line, and an exterior marginal portion foldably connected to the container retention portion at a second fold line.

10. The carrier of claim 9, wherein the container retention features comprise at least one container retention tab foldably connected to the at least one attachment panel and positioned to extend into the at least one container opening.

11. The carrier of claim 9, wherein at least one of the interior marginal portion and the exterior marginal portion comprises a plurality of container engagement portions, each container engagement portion foldably connected to an adjacent container engagement portion.

12. The carrier of claim 1, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

13. The carrier of claim 12, wherein the first plurality of openings is offset from the second plurality of openings.

14. The carrier of claim 13, wherein the front central panel and the back central panel are in at least partial face-to-face contact such that a respective portion of the back central panel is exposed through the first plurality of openings and a respective portion of the front central panel is exposed through the second plurality of openings, the respective portion of the front central panel and the respective portion of the back central panel are for receiving an adhesive.

15. A blank for forming a carrier for holding a plurality of containers, the blank comprising:

a plurality of panels comprising at least one central panel and at least one attachment panel foldably connected to the at least one central panel, the at least one attachment panel comprising container retention features for engaging at least one container of the plurality of containers when the carrier is formed from the blank, the at least one central panel comprises a plurality of openings and is for being positioned between and attached to adjacent containers of the plurality of containers when the carrier is formed from the blank, the plurality of openings comprises a first row of openings and a second row of openings spaced apart from the first row of openings, the first row of openings is for being spaced a first distance from a bottom edge of the at least one central panel when the carrier is formed from the blank, and the second row of openings is spaced a second distance from the bottom edge of the at least one central panel when the carrier is formed from the blank, the second distance is greater than the first distance.

16. The blank of claim 15, wherein the container retention features comprise at least one curved cut in the at least one attachment panel for engaging a portion of at least one container of the plurality of containers.

17. The blank of claim 16, wherein the at least one attachment panel comprises a container retention portion, an interior marginal portion foldably connected to the container retention portion at a first fold line, and an exterior marginal portion foldably connected to the container retention portion at a second fold line.

18. The blank of claim 17, wherein the exterior marginal portion forms a continuous band for engaging at least one container of the plurality of containers.

19. The blank of claim 17, wherein the at least one curved cut interrupts at least one of the first fold line and the second fold line.

20. The blank of claim 17, wherein the at least one curved cut interrupts one of the first fold line and the second fold line, the container retention features further comprise at least one container opening, and the at least one container opening interrupts the other of the first fold line and the second fold line.

21. The blank of claim 17, wherein at least one of the inner marginal portion and the outer marginal portion comprises a plurality of container engagement portions, each container engagement portion foldably connected to an adjacent container engagement portion.

22. The blank of claim 15, wherein the container retention features comprise at least one container opening in the at least one attachment panel for at least partially receiving at least one container of the plurality of containers.

23. The blank of claim 22, wherein the at least one attachment panel comprises a container retention portion, an interior marginal portion foldably connected to the container retention portion at a first fold line, and an exterior marginal portion foldably connected to the container retention portion at a second fold line.

24. The blank of claim 23, wherein the container retention features comprise at least one container retention tab foldably connected to the at least one attachment panel and positioned to extend into the at least one container opening.

25. The blank of claim 23, wherein at least one of the interior marginal portion and the exterior marginal portion comprises a plurality of container engagement portions, each container engagement portion foldably connected to an adjacent container engagement portion.

26. The blank of claim 15, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are for being positioned in communication with the back central panel and the second plurality of openings are for being positioned in communication with the front central panel when the carrier is formed from the blank.

27. The blank of claim 26, wherein the first plurality of openings is for being offset from the second plurality of openings when the carrier is formed from the blank.

28. The blank of claim 27, wherein the front central panel and the back central panel are for being positioned in at least partial face-to-face contact such that a respective portion of the back central panel is exposed through the first plurality of openings and a respective portion of the front central panel is exposed through the second plurality of openings when the carrier is formed from the blank, the respective portion of the front central panel and the respective portion of the back central panel are for receiving an adhesive.

29. A method of forming a carrier for holding a plurality of containers, the method comprising:

obtaining a blank comprising a plurality of panels comprising at least one central panel and at least one attachment panel foldably connected to the at least one central panel, the at least one attachment panel comprising container retention features and the at least one central panel comprises a plurality of openings, the plurality of openings comprises a first row of openings and a second row of openings spaced apart from the first row of openings;

folding the plurality of panels such that the at least one central panel is positioned between adjacent containers of the plurality of containers, such that the first row of openings is spaced a first distance from a bottom edge of the at least one central panel, and such that the second row of openings is spaced a second distance from the bottom edge of the at least one central panel, the second distance is greater than the first distance;

attaching the at least one central panel to at least one container of the plurality of containers; and attaching the attachment panel to at least one container of the plurality of containers by engaging the at least one container of the plurality of containers with the container retention features.

30. The method of claim 29, wherein the container retention features comprise at least one curved cut in the at least one attachment panel for engaging a portion of at least one container of the plurality of containers.

31. The method of claim 30, wherein the at least one attachment panel comprises a container retention portion, an interior marginal portion foldably connected to the container retention portion at a first fold line, and an exterior marginal portion foldably connected to the container retention portion at a second fold line.

32. The method of claim 31, wherein the exterior marginal portion forms a continuous band for engaging at least one container of the plurality of containers.

33. The method of claim 31, wherein the at least one curved cut interrupts at least one of the first fold line and the second fold line.

34. The method of claim 31, wherein the at least one curved cut interrupts one of the first fold line and the second fold line, the container retention features further comprise at least one container opening, and the at least one container opening interrupts the other of the first fold line and the second fold line.

35. The method of claim 31, wherein at least one of the inner marginal portion and the outer marginal portion comprises a plurality of container engagement portions, each container engagement portion foldably connected to an adjacent container engagement portion.

36. The method of claim 29, wherein the container retention features comprise at least one container opening in the at least one attachment panel at least partially receiving at least one container of the plurality of containers.

37. The method of claim 36, wherein the at least one attachment panel comprises a container retention portion, an interior marginal portion foldably connected to the container retention portion at a first fold line, and an exterior marginal portion foldably connected to the container retention portion at a second fold line.

38. The method of claim 37, wherein the container retention features comprise at least one container retention tab foldably connected to the at least one attachment panel and positioned to extend into the at least one container opening.

39. The method of claim 37, wherein at least one of the interior marginal portion and the exterior marginal portion comprises a plurality of container engagement portions, each container engagement portion foldably connected to an adjacent container engagement portion.

40. The method of claim 29, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings, the folding the plurality of panels comprises positioning the first plurality of openings in communication with the back central panel and positioning the second plurality of openings in communication with the front central panel.

41. The method of claim 40, wherein the first plurality of openings is offset from the second plurality of openings.

42. The method of claim 41, wherein the folding the plurality of panels comprises positioning the front central panel and the back central panel in at least partial face-to-face contact such that a respective portion of the back central panel is exposed through the first plurality of openings and such that a respective portion of the front central panel is exposed through the second plurality of openings, the respective portion of the front central panel and the respective portion of the back central panel are for receiving an adhesive.

43. A package, the package comprising;

a plurality of containers;

a carrier holding a plurality of containers, the carrier comprising:

a plurality of panels comprising at least one central panel and at least one attachment panel foldably connected to the at least one central panel, the at least one attachment panel comprising container retention features engaging at least one container of the plurality of containers, the at least one central panel comprises a plurality of openings and is positioned between and attached to adjacent containers of the plurality of containers, the plurality of openings comprises a first row of openings and a second row of openings spaced apart from the first row of openings, the first row of openings is spaced a first distance from a bottom edge of the at least one central panel, and the second row of openings is spaced a second distance from the bottom edge of the at least one central panel, the second distance is greater than the first distance.

44. The package of claim 43, wherein the container retention features comprise at least one curved cut in the at least one attachment panel engaging a portion of at least one container of the plurality of containers.

45. The package of claim 44, wherein the at least one attachment panel comprises a container retention portion, an interior marginal portion foldably connected to the container retention portion at a first fold line, and an exterior marginal portion foldably connected to the container retention portion at a second fold line.

46. The package of claim 45, wherein the exterior marginal portion forms a continuous band engaging at least one container of the plurality of containers.

47. The package of claim 45, wherein the at least one curved cut interrupts at least one of the first fold line and the second fold line.

48. The package of claim 45, wherein the at least one curved cut interrupts one of the first fold line and the second fold line, the container retention features further comprise at least one container opening, and the at least one container opening interrupts the other of the first fold line and the second fold line.

49. The package of claim 45, wherein at least one of the inner marginal portion and the outer marginal portion comprises a plurality of container engagement portions, each container engagement portion foldably connected to an adjacent container engagement portion.

50. The package of claim 43, wherein the container retention features comprise at least one container opening in the at least one attachment panel at least partially receiving at least one container of the plurality of containers.

51. The package of claim 50, wherein the at least one attachment panel comprises a container retention portion, an interior marginal portion foldably connected to the container retention portion at a first fold line, and an exterior marginal portion foldably connected to the container retention portion at a second fold line.

52. The package of claim 51, wherein the container retention features comprise at least one container retention tab foldably connected to the at least one attachment panel and positioned to extend into the at least one container opening.

53. The package of claim 51, wherein at least one of the interior marginal portion and the exterior marginal portion comprises a plurality of container engagement portions, each container engagement portion foldably connected to an adjacent container engagement portion.

54. The package of claim 43, wherein the at least one central panel is a front central panel, the plurality of panels further comprises a back central panel, the at least one attachment panel is a front attachment panel foldably connected to the front central panel, and the plurality of panels further comprises a back attachment panel foldably connected to the back central panel, the plurality of openings is a first plurality of openings in the front central panel, and the back central panel comprises a second plurality of openings such that the first plurality of openings are in communication with the back central panel and the second plurality of openings are in communication with the front central panel.

55. The package of claim 54, wherein the first plurality of openings is offset from the second plurality of openings.

56. The package of claim 55, wherein the front central panel and the back central panel are in at least partial face-to-face contact such that a respective portion of the back central panel is exposed through the first plurality of openings and a respective portion of the front central panel is exposed through the second plurality of openings, the respective portion of the front central panel and the respective portion of the back central panel are for receiving an adhesive.

* * * * *